US006065621A

United States Patent [19]

Fatemi et al.

[11] Patent Number: 6,065,621

[45] Date of Patent: May 23, 2000

[54] PORTABLE AND TOWABLE LIFT MECHANISM

[76] Inventors: Ray Fatemi, 462 Gresham Dr., Fairlawn, Ohio 44333; Stan Gilas, 44 Rodcliff Road, Box 462, Tottenham, Ontario, Canada

[21] Appl. No.: 09/165,664

[22] Filed: Oct. 3, 1998

Related U.S. Application Data

[60] Provisional application No. 60/061,410, Oct. 3, 1997.

[51] Int. Cl.[7] ..... B66C 23/90

[52] U.S. Cl. ..... 212/301; 212/264; 212/901

[58] Field of Search ..... 212/301, 231, 212/230, 343, 345, 901, 180, 277, 299, 348, 292, 264; 414/476.1

[56] References Cited

U.S. PATENT DOCUMENTS

| | | | |
|---|---|---|---|
| 1,828,905 | 10/1931 | Mossay | 212/901 |
| 2,438,415 | 3/1948 | Riboud | 280/476.1 |
| 2,627,983 | 2/1953 | Lathers | 212/180 |
| 2,919,036 | 12/1959 | Raymond | 212/231 |
| 3,237,781 | 3/1966 | Heigl | 212/301 |
| 3,458,068 | 7/1969 | Scott | 280/476.1 |
| 3,900,119 | 8/1975 | Olsen | 212/301 |
| 4,202,453 | 5/1980 | Wilkes et al. | 212/231 |
| 4,540,096 | 9/1985 | Orvis | 212/348 |
| 4,749,324 | 6/1988 | Rullison | 212/901 |
| 4,895,262 | 1/1990 | Maso | 212/277 |
| 5,393,193 | 2/1995 | Dagg | 212/292 |

FOREIGN PATENT DOCUMENTS

| | | | |
|---|---|---|---|
| 2587320 | 3/1987 | France | 212/277 |
| 1100902 | 3/1961 | Germany | 212/231 |
| 2141006 | 2/1973 | Germany | 212/343 |
| 3015590 | 10/1981 | Germany | 212/299 |
| 719430 | 11/1966 | Italy | 212/901 |
| 317894 | 8/1929 | United Kingdom | 212/901 |

*Primary Examiner*—Thomas J. Brahan
*Attorney, Agent, or Firm*—John M. Vasuta

[57] ABSTRACT

An improved lift mechanism that is portable and towable, and has a telescopic and angularly adjustable load carrying boom, four telescopic support legs with pivotable wheels thereon, and a low center of gravity frame of a two part construction pivotally connected together and having a tilt indicator warning thereon.

14 Claims, 23 Drawing Sheets

PORTABLE AND TOWABLE LIFT MECHANISM

CROSS REFERENCE

This application claims priority from U.S. Provisional Patent Application no. 60/061,410, filed on Oct. 3, 1997.

BACKGROUND OF THE INVENTION

1. Technical Field

The present invention relates to cranes or lifts. More particularly, the present invention relates to portable and towable cranes or lifts that are capable of safely lifting thousands of pounds and/or telescoping to distances approaching or beyond 30 feet at angles of between substantially horizontal to almost vertical while also being capable of compact storage for towing. Specifically, the present invention is a portable and towable lift mechanism having a telescopic and angularly adjustable load carrying boom, four telescopic support legs with pivotable wheels thereon, and a low center of gravity frame of a two part construction pivotally connected together and having a tilt indicator warning thereon.

2. Background Information

For hundreds of years, people have needed and/or desired to lift or move heavy or bulky objects. More particularly, people have needed and/or desired to vertically or substantially vertically lift heavy or bulky objects up into the air, to suspend heavy or bulky objects angularly outward and at least slightly in the air, or to both lift and suspend the object. Often these needs occur for one of two reasons, a bulky and/or heavy object either (1) needs lifted into the air for a temporary time or to be placed on a surface or suspended from a frame in the air, or (2) needs lifted over an obstacle and set down on the other side.

Current technology includes large relatively or completely immobile cranes. These cranes are generally used on construction sites where the crane is transported via trailer by large trucks such as tractor-trailers. These large cranes are expensive to own or rent, not portable or hard and time consuming to move, not towable as trailering is typically necessary, not readily transported to remote sites, not easily positioned as needed in tight spots (often not possible), etc.

Alternatively, many manufacturers of cranes, lifts, and hoists have attempted to downsize this large crane technology to a smaller, more affordable, and user friendly lift. The result is often an unstable, dangerous, and otherwise undesirable lift that includes an insufficient frame for supporting substantial loads. Theses small lifts are often sufficient for small jobs such as lifting car engines weighing several hundred pounds, but are generally not capable of lifting substantial weights of approaching if not exceeding a thousand pounds, if not more. These booms often are inferior and hard to use, and may be capable of lifting only a small weight safely. Finally, these lifts either have fixed booms or extendible booms of only a small distance such as a few feet upwards to approximately ten feet.

OBJECTIVES AND SUMMARY OF THE INVENTION

It is an objective of the present invention to provide an improved crane, lift or hoist.

It is further an objective of the present invention to provide an improved portable crane, lift or hoist.

It is further an objective of the present invention to provide an improved towable crane, lift, or hoist that is towable at highway speeds.

It is further an objective of the present invention to provide an improved crane, lift or hoist of a retracted size equivalent to a standard vehicle tow behind trailer of an approximately 6 to 8 foot width (a width that does not require wide load designation and have limited transportation due to road and daylight restrictions) and approximately 8 to 12 foot length (standard trailer length).

It is further an objective of the present invention to provide an improved trailer sized crane, lift or hoist that is stable during both towing and fully extended use.

It is further an objective of the present invention to provide an improved trailer sized crane, lift or hoist that extends to approximately between 8 and 12 feet in width and approximately between 10 and 16 feet in length.

It is further an objective of the present invention to provide an improved trailer sized crane, lift or hoist that is capable of safely lifting thousands of pounds.

It is further an objective of the present invention to provide an improved trailer sized crane, lift or hoist that includes a telescoping boom that is capable of retraction to between approximately 6 and 8 feet in length while extendible to approximately between 20 and 35 feet in length.

It is further an objective of the present invention to provide an improved trailer sized crane, lift or hoist that includes a telescoping boom that is capable of loaded angular adjustment from approximately 5° to 15° below horizontal to approximately 75° to 85° above horizontal.

It is further an objective of the present invention to provide an improved trailer sized crane, lift or hoist that includes a two part load supporting frame that is pivotally connected.

It is further an objective of the present invention to provide an improved trailer sized crane, lift or hoist that includes a tilt indicator mechanism for displaying unsafe loads and/or angles in combination with loads.

It is further an objective of the present invention to provide an improved trailer sized crane, lift or hoist that includes a safety switch that deactivates the lifting and/or extending of the boom.

It is further an objective of the present invention to provide an improved trailer sized crane, lift or hoist that includes a mechanism or construction that assures properly sequenced telescoping of the boom.

Still other advantages and benefits of the invention will become apparent to those skilled in the art upon a reading and understanding of the following summary and detailed description.

Accordingly, the present invention satisfies these and other objectives as it relates to lift mechanisms.

BRIEF DESCRIPTION OF THE DRAWINGS

Preferred embodiment of the invention, illustrative of the best mode in which applicant has contemplated applying the principles, are set forth in the following description and are shown in the drawings and are particularly and distinctly pointed out and set forth in the appended claims.

FIG. 14 is a top plan view similar to FIG. 13 showing the boom in the extended position.

FIG. 18 is a perspective view of the tilt arm indicator of FIG. 17.

Similar numerals refer to similar parts throughout the drawings.

DESCRIPTION OF THE PREFERRED EMBODIMENT

Figure 1:
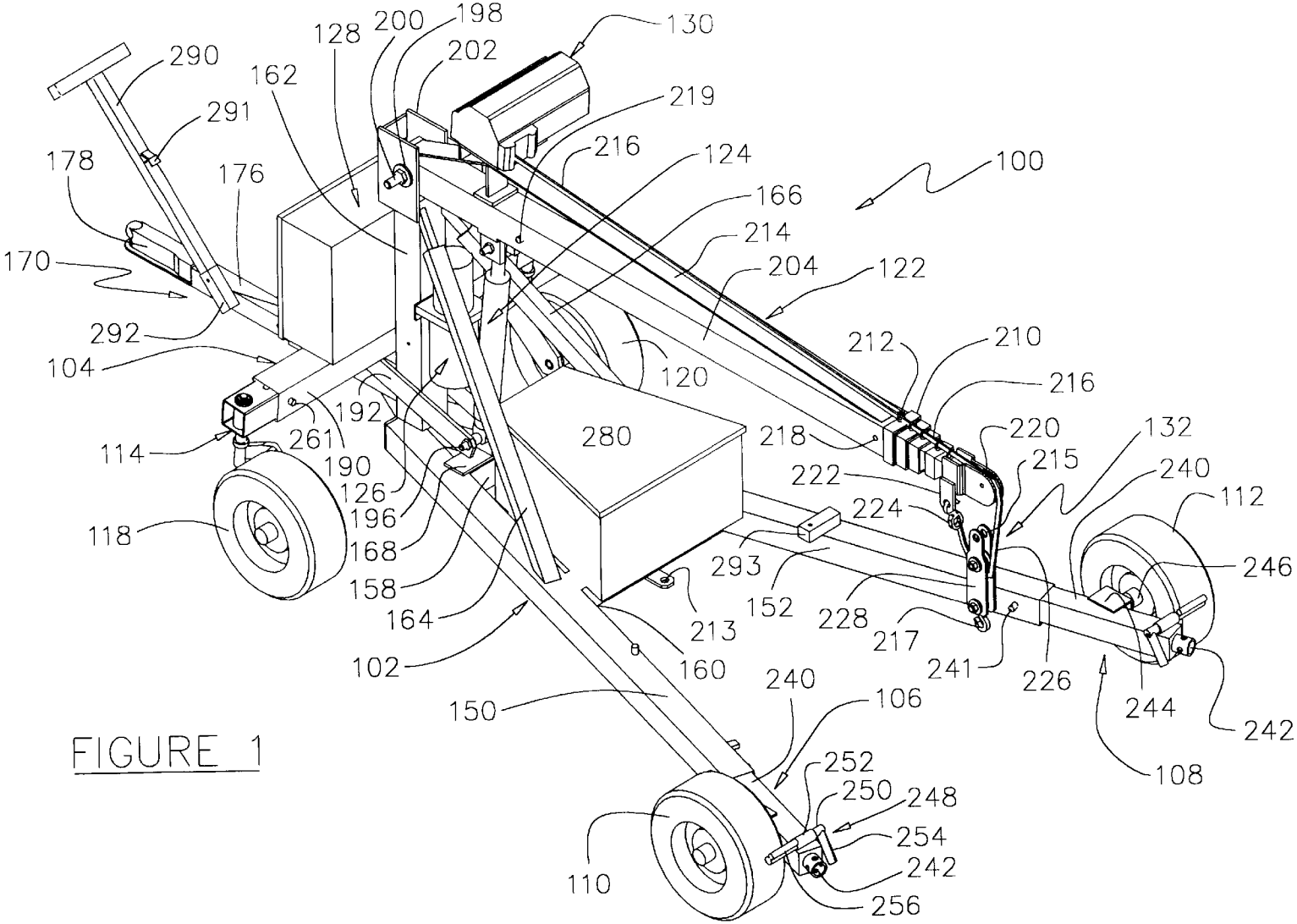
FIG. 1 is a first perspective view of one embodiment of the lift mechanism of the present invention with the telescoping boom and legs retracted.
Figure 2:
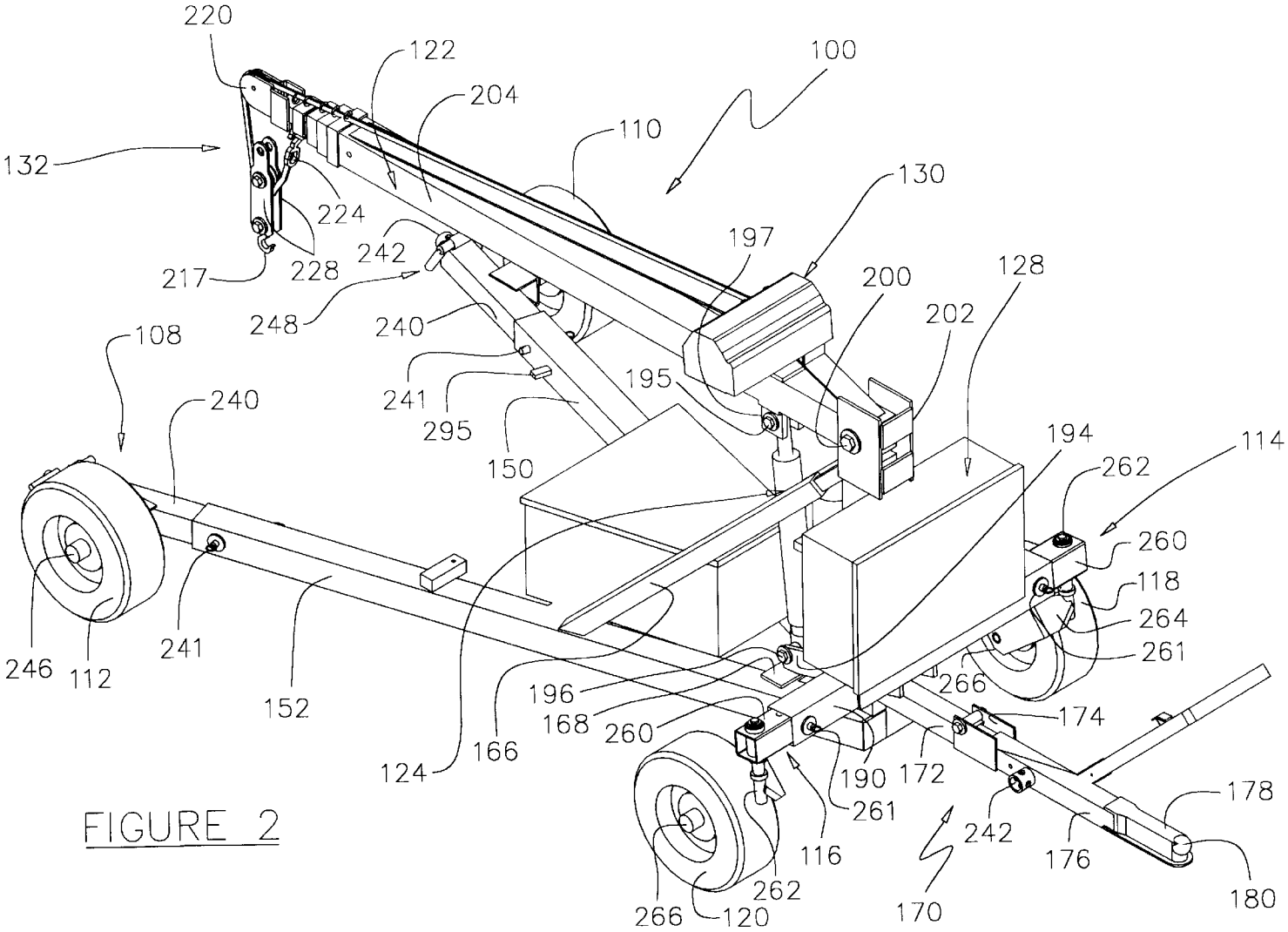
FIG. 2 is a second perspective view of the embodiment of the lift mechanism as shown in FIG. 1.
Figure 3:
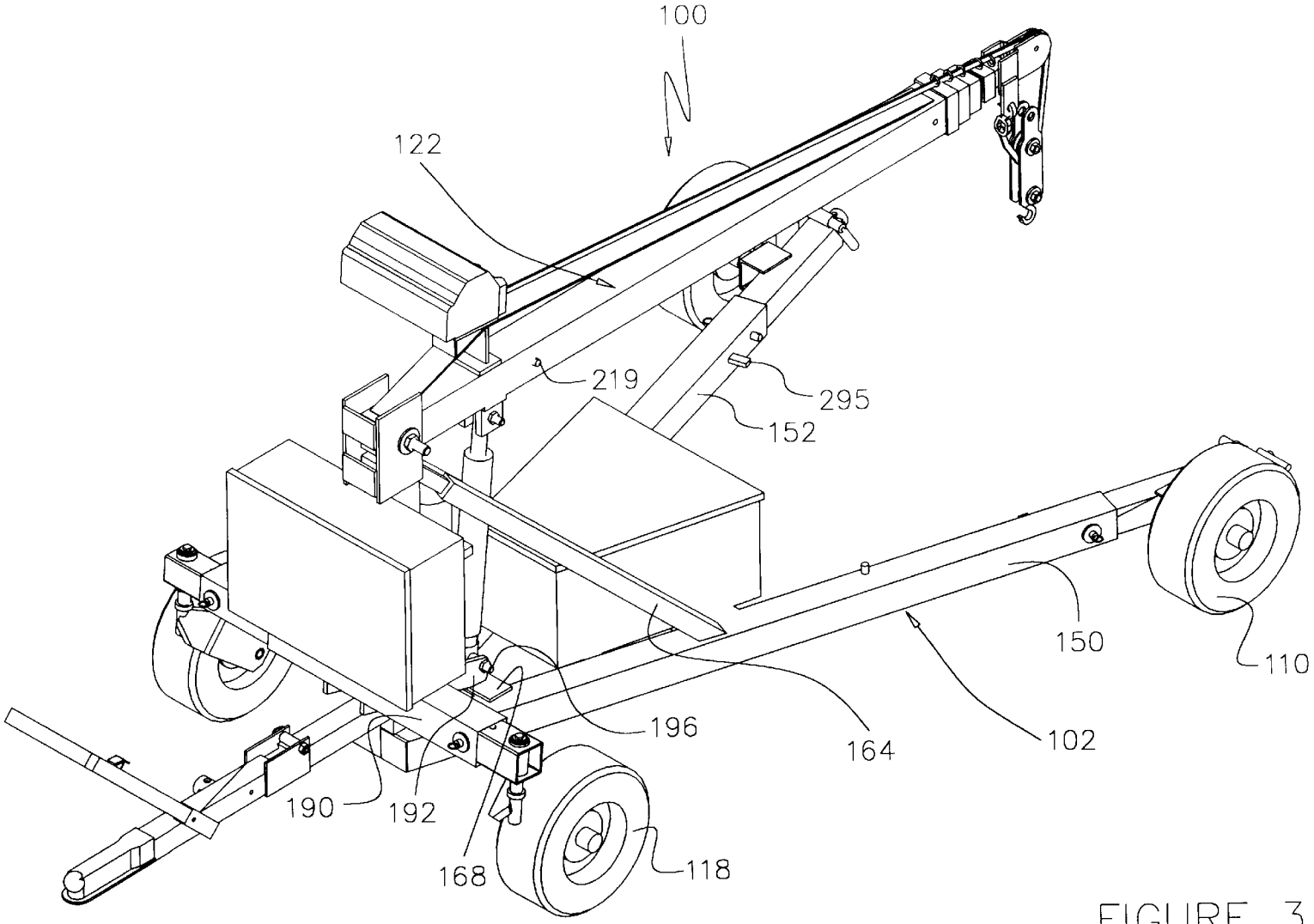
FIG. 3 is a third perspective view of the embodiment of the lift mechanism as shown in FIG. 1.
Figure 4:
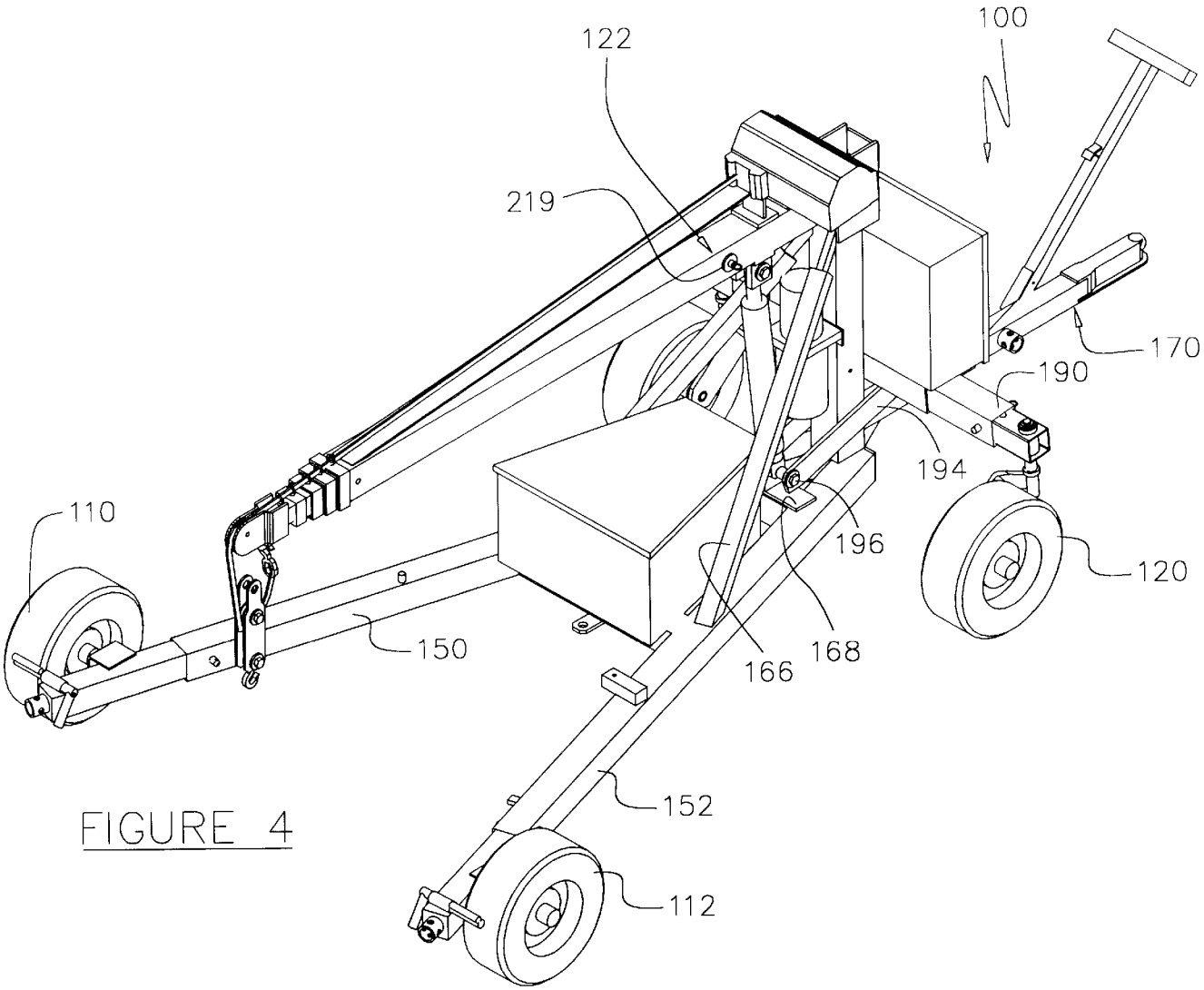
FIG. 4 is a fourth perspective view of the embodiment of the lift mechanism as shown in FIG. 1.
Figure 5:
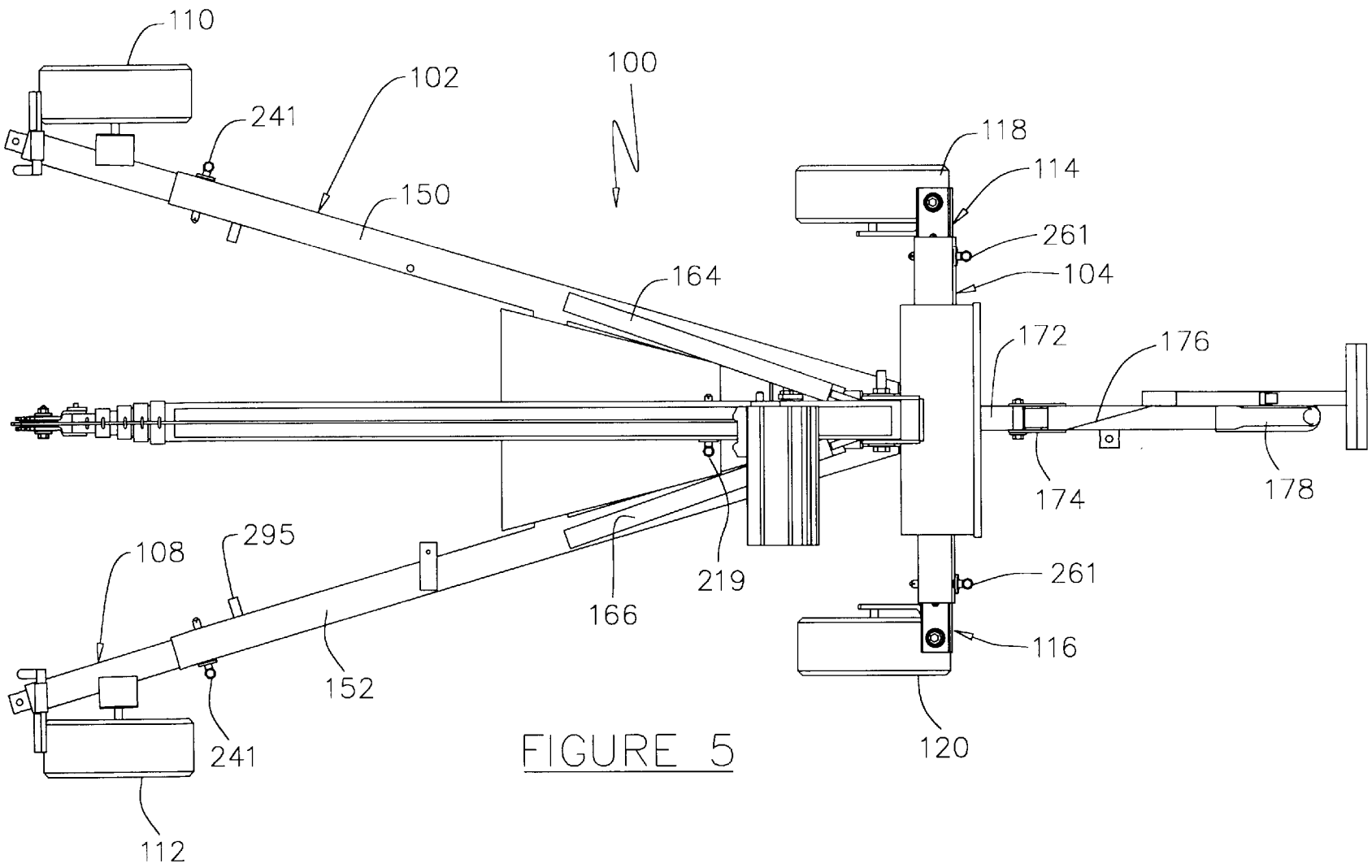
FIG. 5 is a top plan view of the embodiment of the lift mechanism as shown in FIG. 1.
Figure 6:
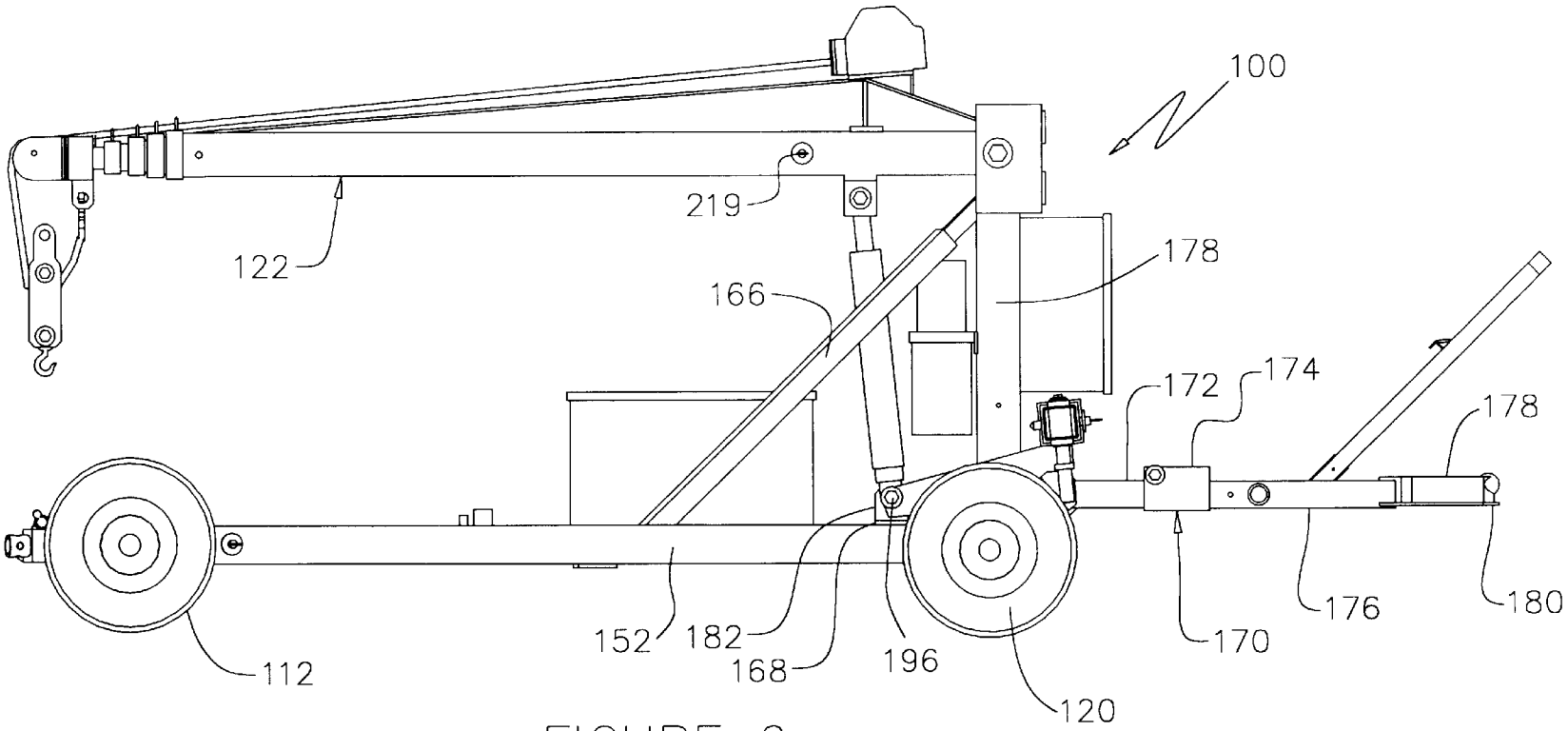
FIG. 6 is a left side elevational view of the embodiment of the lift mechanism as shown in FIG. 1.
Figure 7:
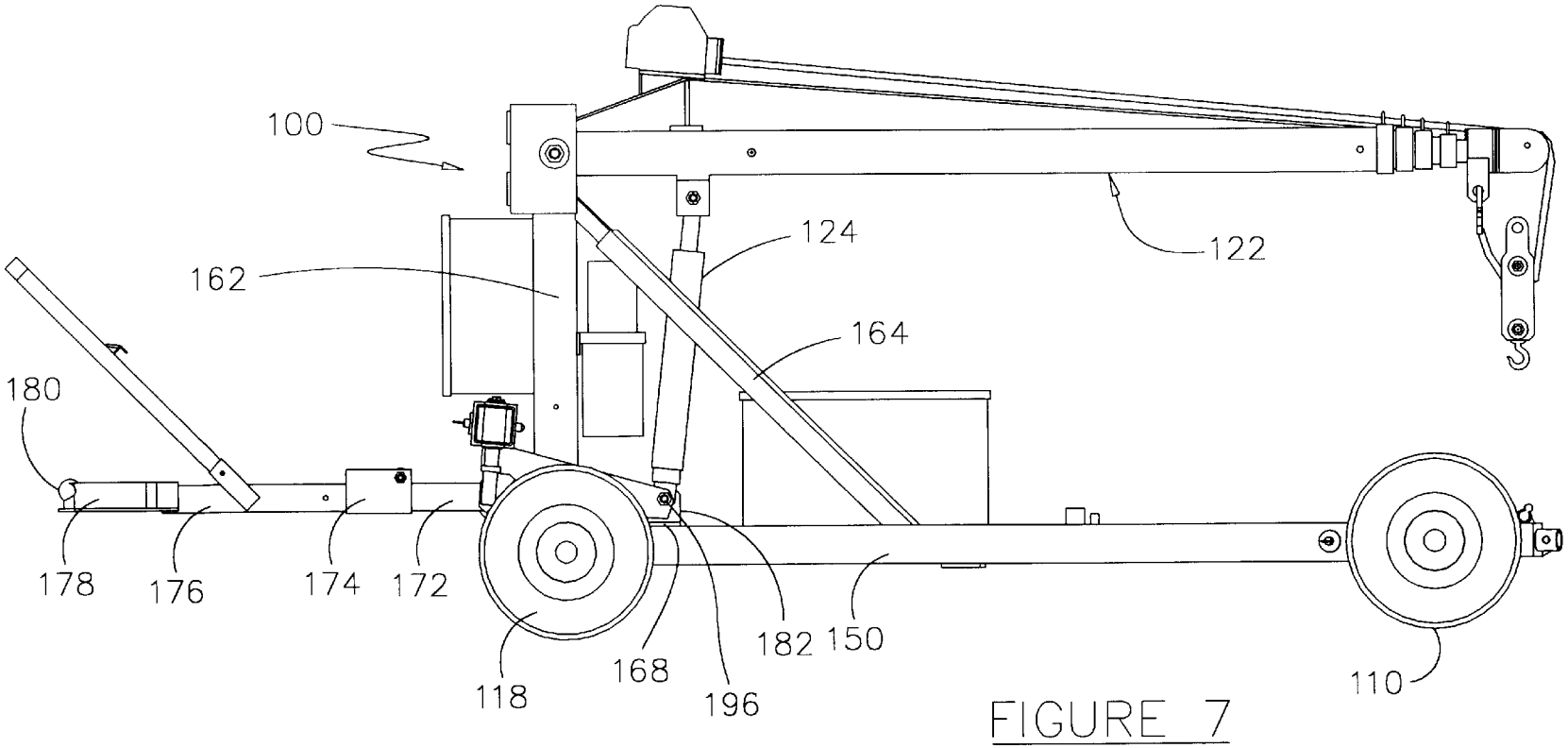
FIG. 7 is a right side elevational view of the embodiment of the lift mechanism as shown in FIG. 1.
Figure 8:
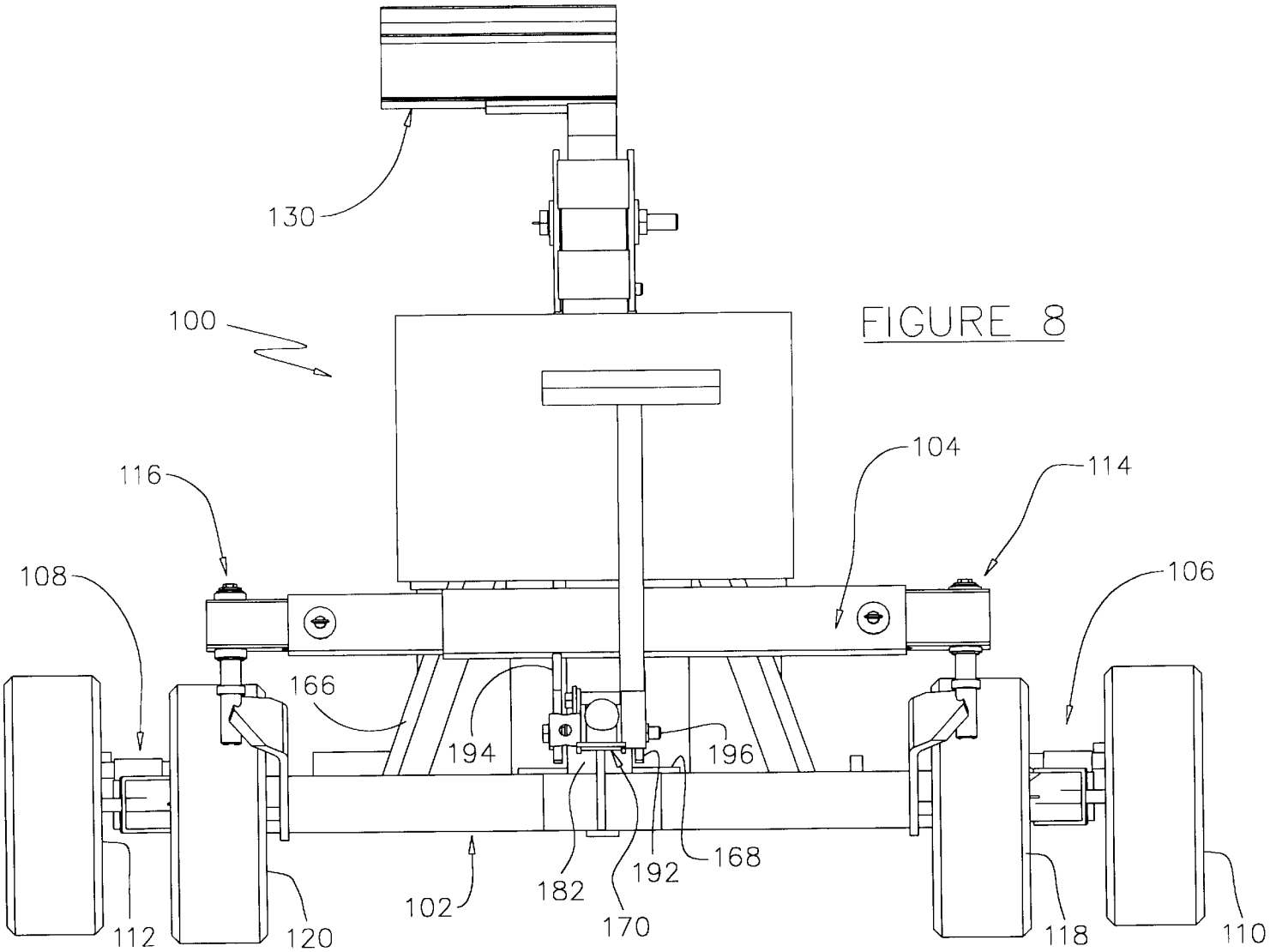
FIG. 8 is a front side elevational view of the embodiment of the lift mechanism as shown in FIG. 1.
Figure 9:
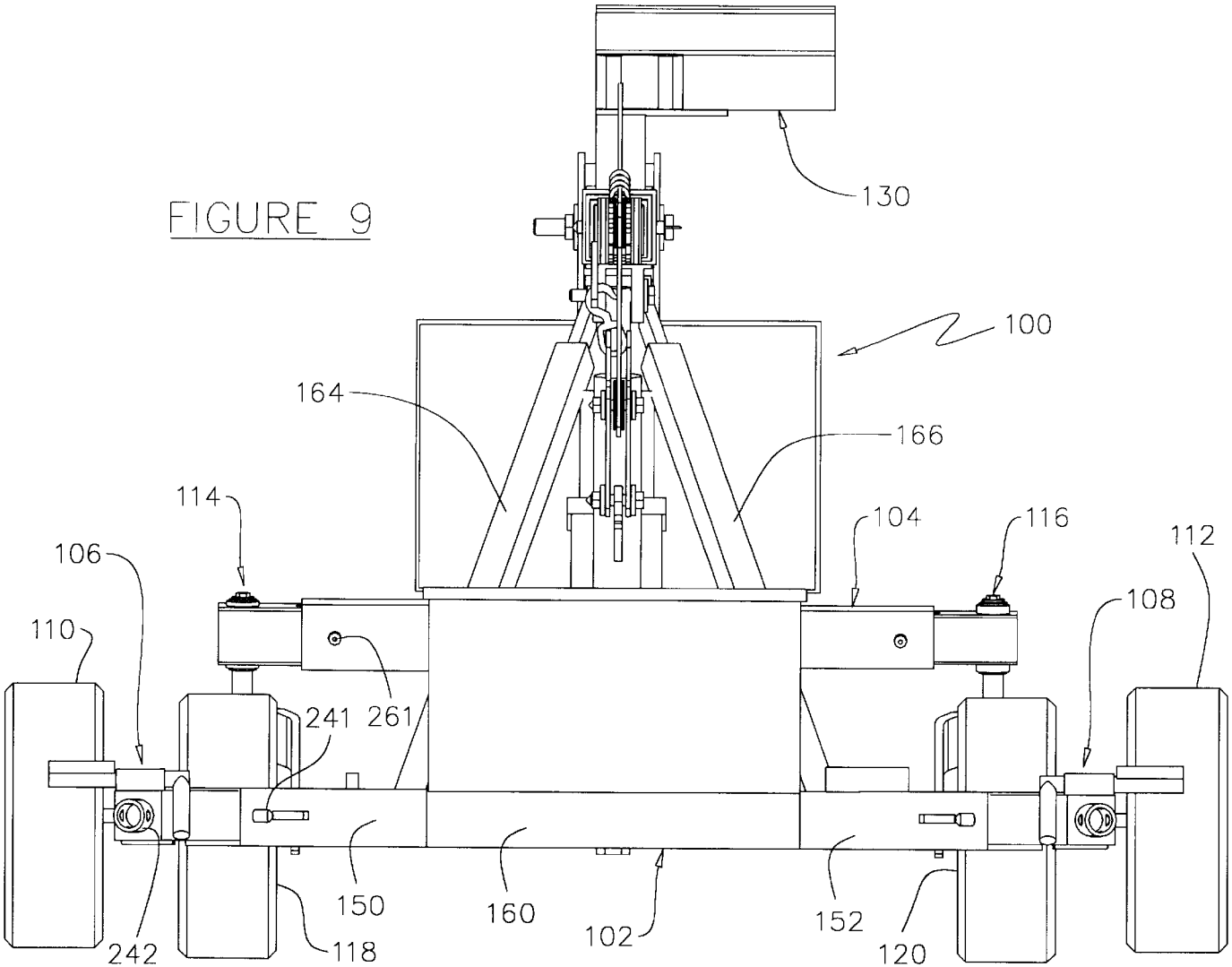
FIG. 9 is a back side elevational view of the embodiment of the lift mechanism as shown in FIG. 1.

The improved lift mechanism of the present invention is indicated generally at 100 as is best shown overall in FIGS. 1–13 while in detail as to specific elements in FIGS. 14–30D. The lift mechanism 100 is shown generally in perspective in FIGS. 1–4 as including a first frame 102, a second frame 104, a pair of rear retractable and extendible leg extensions (or wheel frames) 106 and 108, a rear wheel 110 and 112 on each rear wheel frame, a pair of front retractable and extendible outriggers (wheel frames) 114 and 116, a front wheel 118 and 120 on each front wheel frame, a selectively retractable and extendible boom 122, a boom angle actuator 124, an actuator drive device 126 in communication with the boom angle actuator such as by electrical or fluid lines, a power supply 128 in communication with the selected parts of the lift mechanism that need power, a winch 130 with a controller thereon and in communication with the power supply such as by electrical lines, a snatch block 132, a tilt indicator 134, a safety switch or switches 136, a remote winch control or switch box 138, and a remote actuator control or switch box 140.

Figure 10:
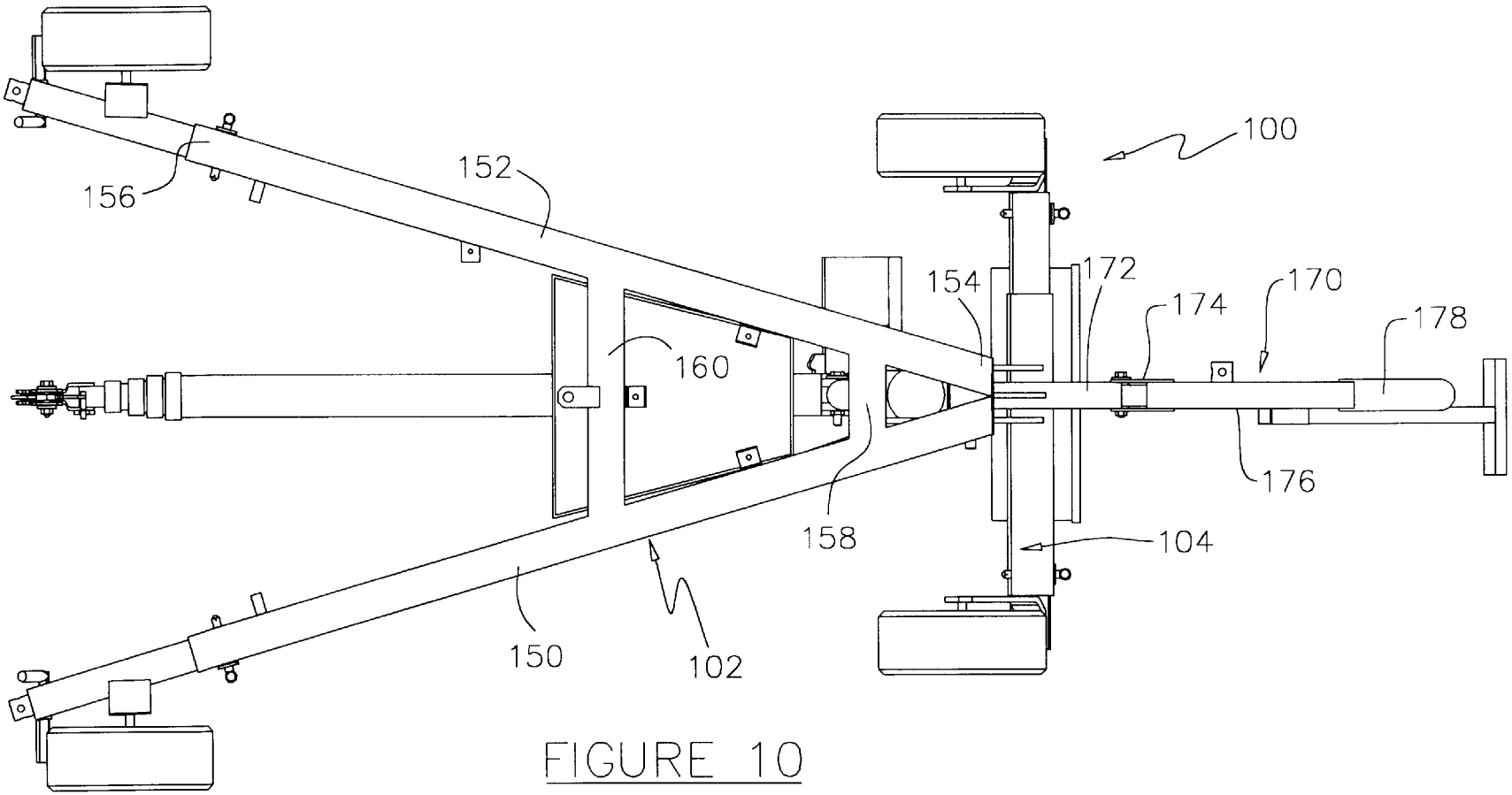
FIG. 10 is a bottom plan view of the embodiment of the lift mechanism as shown in FIG. 1.

First frame 102 includes a pair of legs 150 and 152 as shown in FIGS. 1–13 and best shown in FIG. 10, each of which has a proximate end 154 and a distal end 156. The proximate ends 154 of the legs are adjacent one another while the legs diverge away from each other thereafter such that the distal ends 156 are spaced apart. Typically, these distal ends and preferably the entire leg is of a square (or rectangular) and hollow cross section.

First frame 102 also includes cross supports 158 and 160 as shown in FIG. 10 which extend between the legs. As better shown in FIGS. 6 and 7, first frame 102 further includes a vertical tower 162 extending upward out of the proximate ends 154 of the legs 150 and 152 for supporting boom 122, and a pair of angular supports 164 and 166 (see FIGS. 1 and 9) extending between the vertical tower 162 and legs 150 and 152. First frame 102 also further includes a pivot support plate 168 connected to the legs 150 and 152 on the upper surface thereof, and a tongue 170 extending substantially horizontally and rigidly from the vertical tower 162.

The tongue has a first rigid portion 172, a hinge 174, a second rigid portion 176 that is pivotal about the hinge 174, and a hitch portion 178 with a ball hitch socket 180 therein. A sliding lock is also provided within, underneath, adjacent to or around the hinge 174 and at least one of the adjacent first or second rigid portions 172 and 176 whereby the sliding lock slides from a first position where hinge is locked resulting in a rigid and straight structure from the first to second portions as shown in FIGS. 1–8 to a second position where the lock does not block the hinge from freely pivoting (such free pivoting allowing the first rigid portion 172 to pivot upward about hinge 174).

Second frame 104 includes a main axle or leg 190 of preferably a square (or rectangular) and hollow cross section, and a pair of pivot arms 192 and 194. The pivot arms 192 and 194 are rigidly connected approximate one end to leg 190 and extend to pivot points at pivot support plate 168 where pivot connectors 196 pivotally connect the other end of arms 192 and 194 to support 170.

Specifically, the first and second frames 102 and 104 are pivotally connected at pivot connectors 196 which extend through a hole in pivot arms 192 and 194 and secure such arms to flanges 182 via holes therein where the flanges are extending outward from pivot support plate168. This allows the first and second frames to separately move during both transportation and loading. As will be described later, this movement during loading allows the tilt indicator 134 to properly show the tilt of the overall lift mechanism 100 or lack thereof.

Further as to the pivot point, one end of the boom angle actuator 124 (which is preferably a hydraulic cylinder with a drive rod that is actuatable into and out of hydraulic chamber) is also pivotally connected at pivot connectors 194 as shown in FIGS. 1–4. The other end of the boom angle actuator is pivotally connected to boom 122 via pivot pin 195 at flanges 197. The flanges 197 are rigidly affixed to the boom at a point spaced apart from the pivot point 198 of the boom. This pivot point is defined by the pivot and fastening rod 200 where the boom is attached via this fastening rod 200 through 3-sided mounting bracket 202, which is rigidly affixed to the vertical tower 162, and one end of the boom as best shown in FIGS. 1–4.

Figure 11:
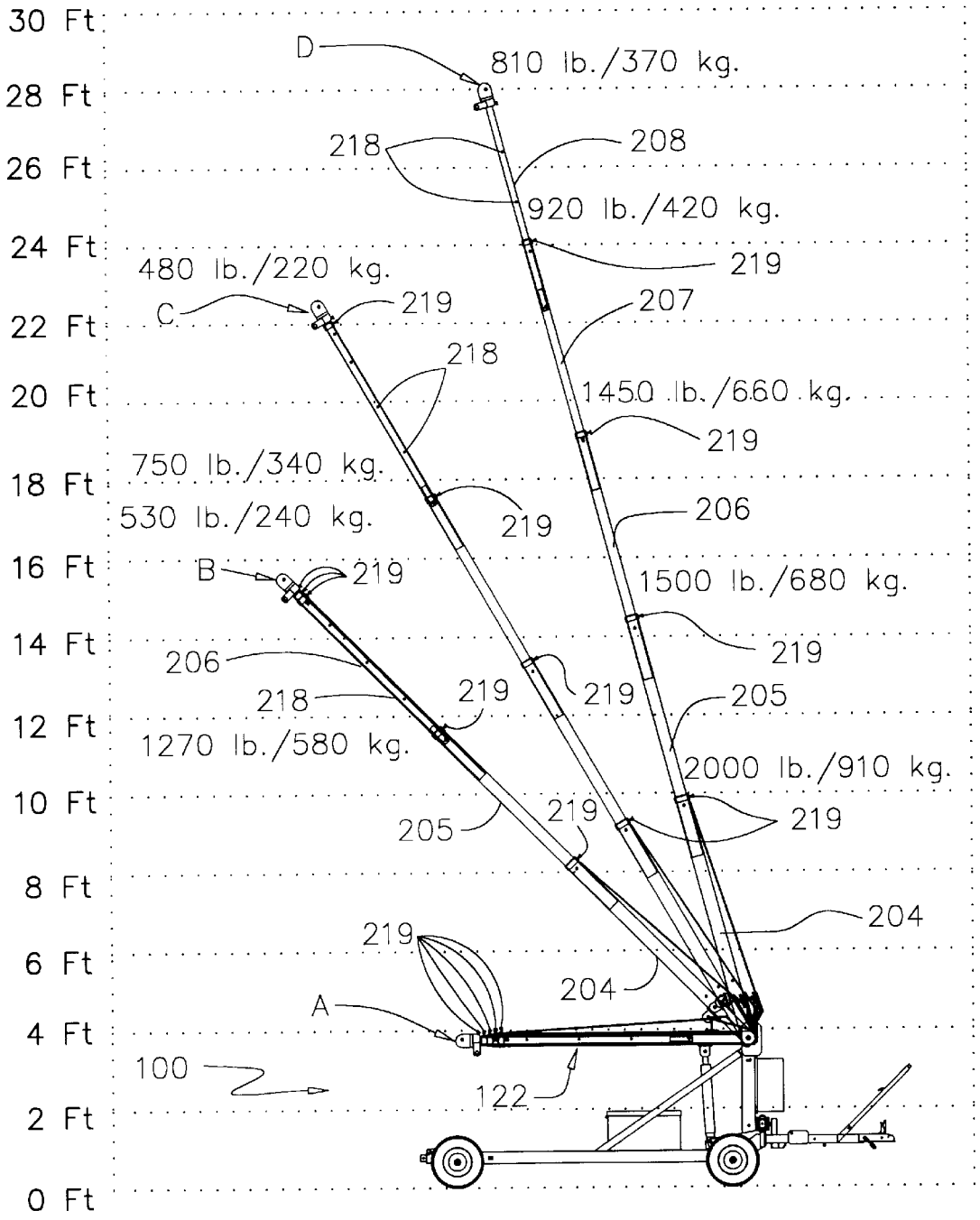
FIG. 11 is a side elevational view of the embodiment of the lift mechanism as shown in FIG. 1 with the boom shown in four distinct positions, namely a fully retracted and horizontal position, a two section extended (three total sections used) and 45° from horizontal angled position, a three section extended (four total sections used) and 60° from horizontal angled position, and a four section or fully extended (all five sections used) and 75° from horizontal angled position.
Figure 13:
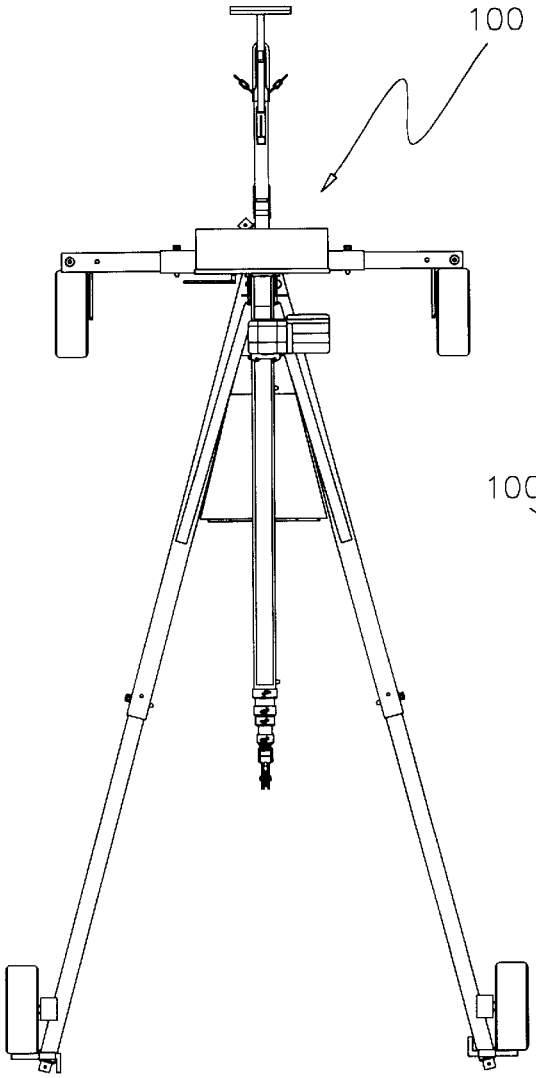
FIG. 13 is a top plan view similar to the view in FIG. 12 showing the legs of lift mechanism in fully extended positions.
Figure 12:
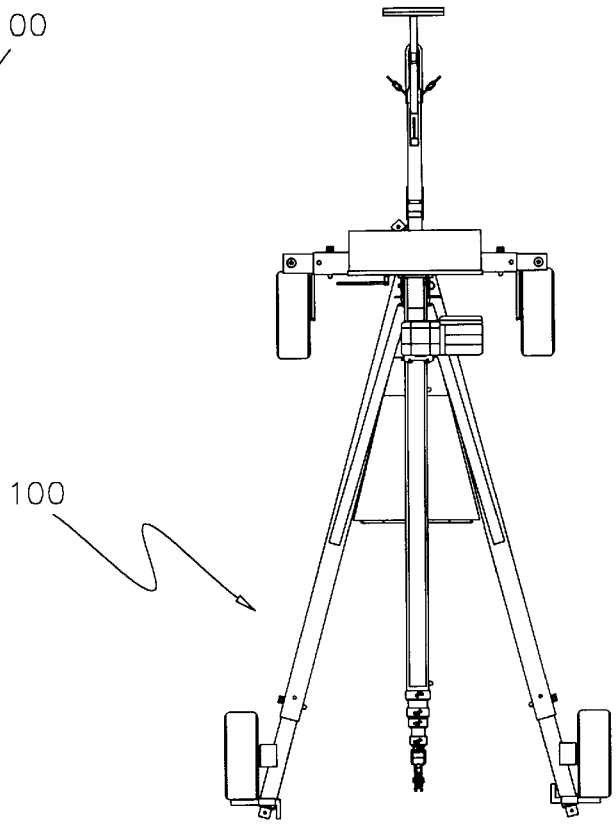
FIG. 12 is a top plan view of the embodiment of the lift mechanism shown in FIG. 1 with its legs fully retracted as similarly shown in FIG. 5.
Figure 15:
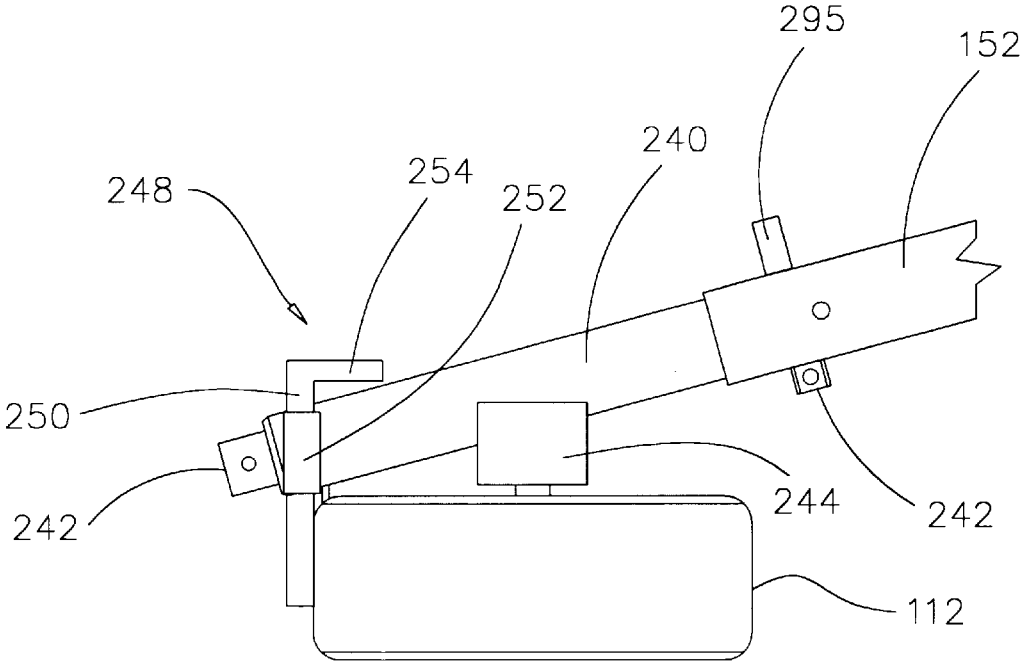
FIG. 15 is a top plan view of an enlarged and broken away nature of the rear wheels and specifically the locking bar of FIGS. 1–14 locked against the wheel.
Figure 16:
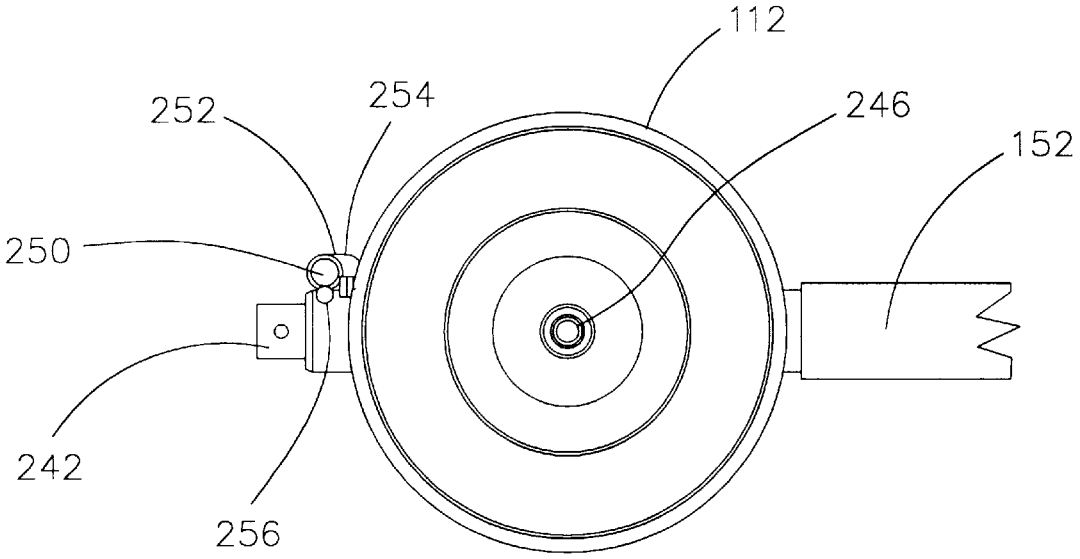
FIG. 16 is a side elevational view of an enlarged and broken away nature of the rear wheels and specifically the locking bar of FIG. 15.
Figure 17:
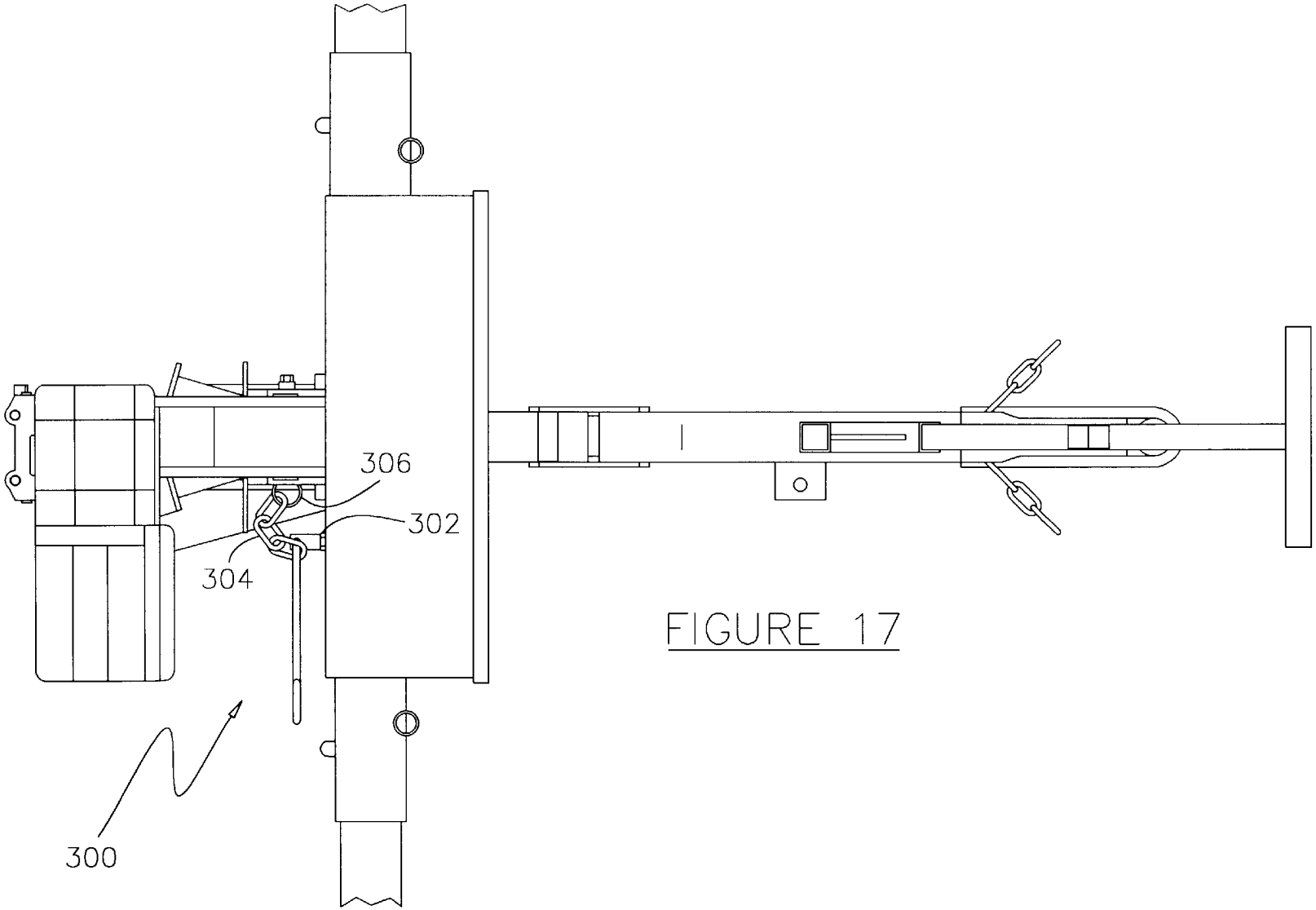
FIG. 17 is a top plan view of an enlarged and broken away nature of the lift mechanism showing the tilt indicator on the lift mechanism.
Figure 21:
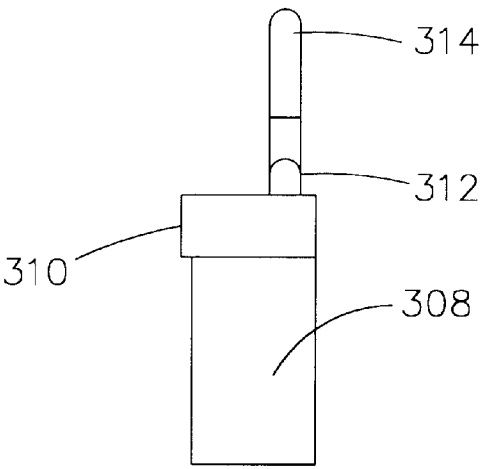
FIG. 21 is an end elevational view of the tilt indicator arm of FIGS. 17–20.
Figure 19:
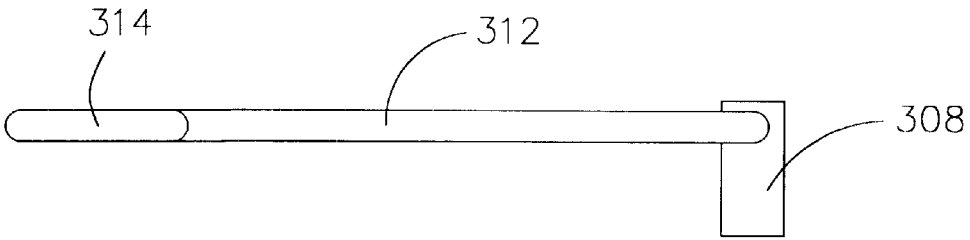
FIG. 19 is a top plan view of the tilt indicator arm of FIGS. 17.
Figure 20:
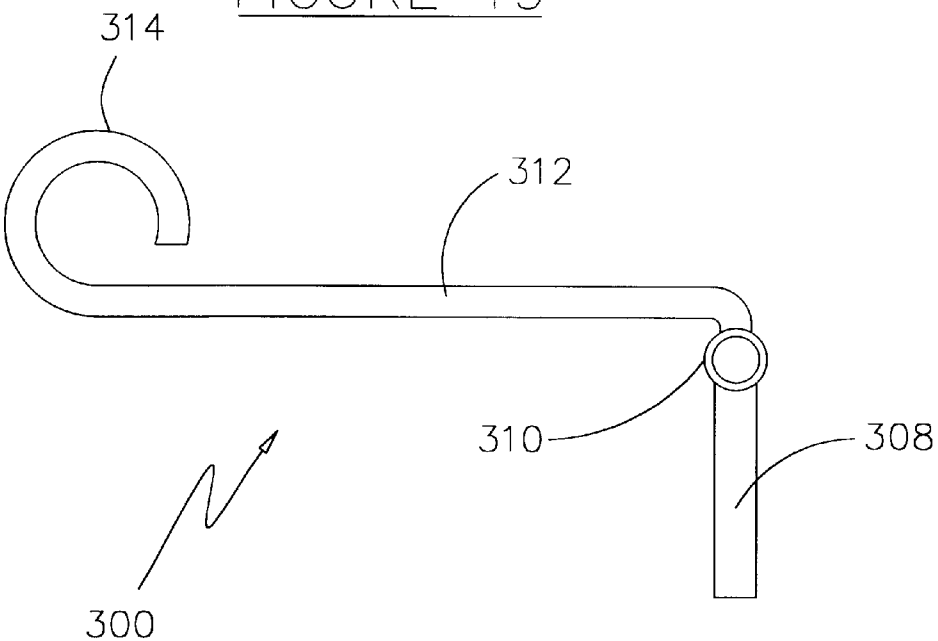
FIG. 20 is a front elevational view of the tilt indicator arm of FIGS. 17–19.
Figure 22:
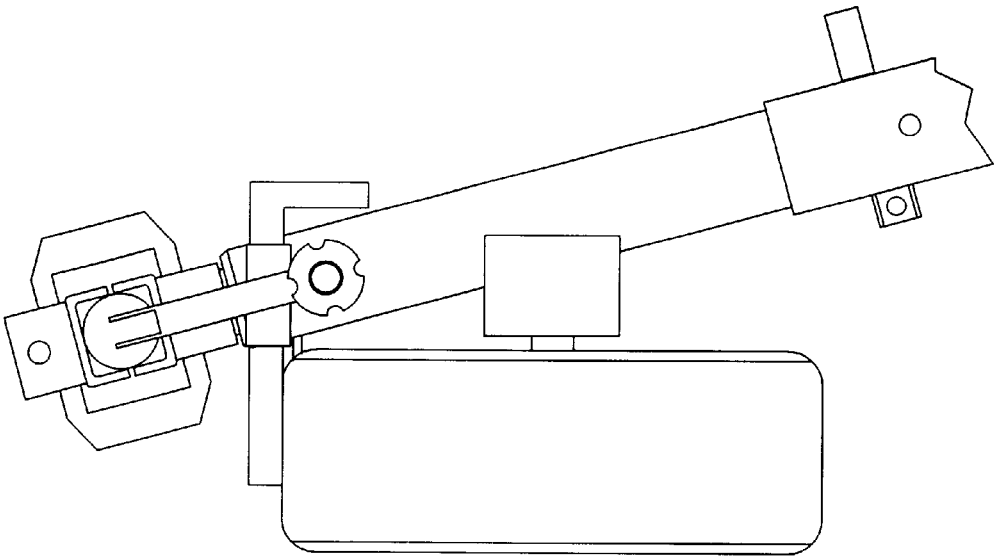
FIG. 22 is a top plan view of an enlarged and broken away nature of a rear wheel with a stabilizing jack attached thereto.
Figure 23:
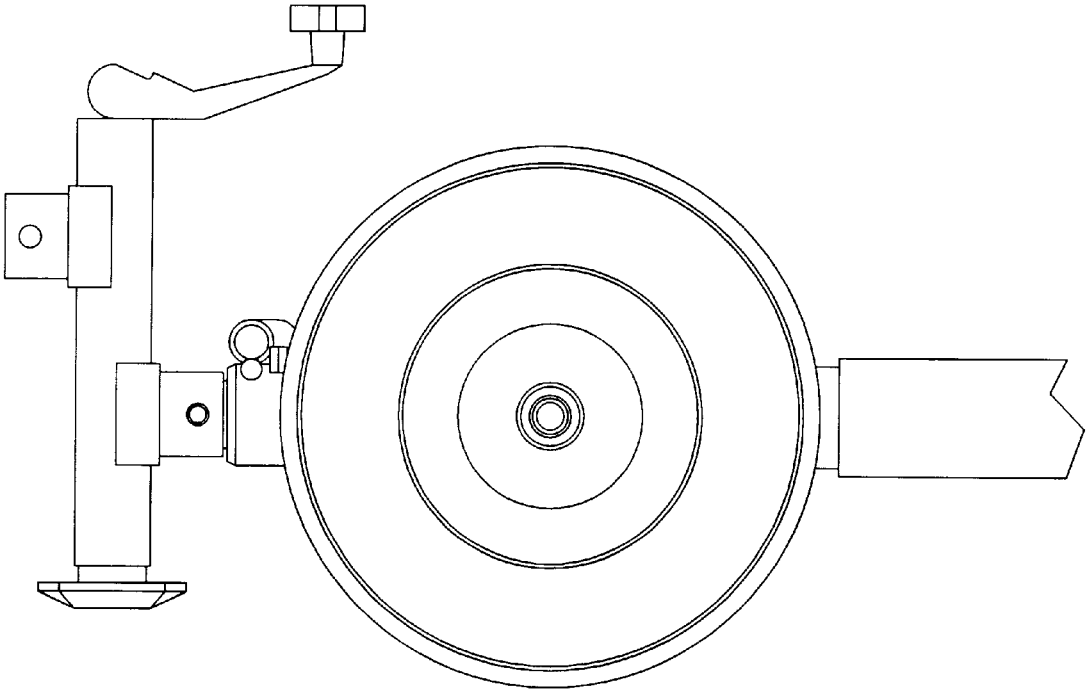
FIG. 23 is a side elevational view of an enlarged and broken away nature of the rear wheel and jack of FIG. 22.
Figure 24:
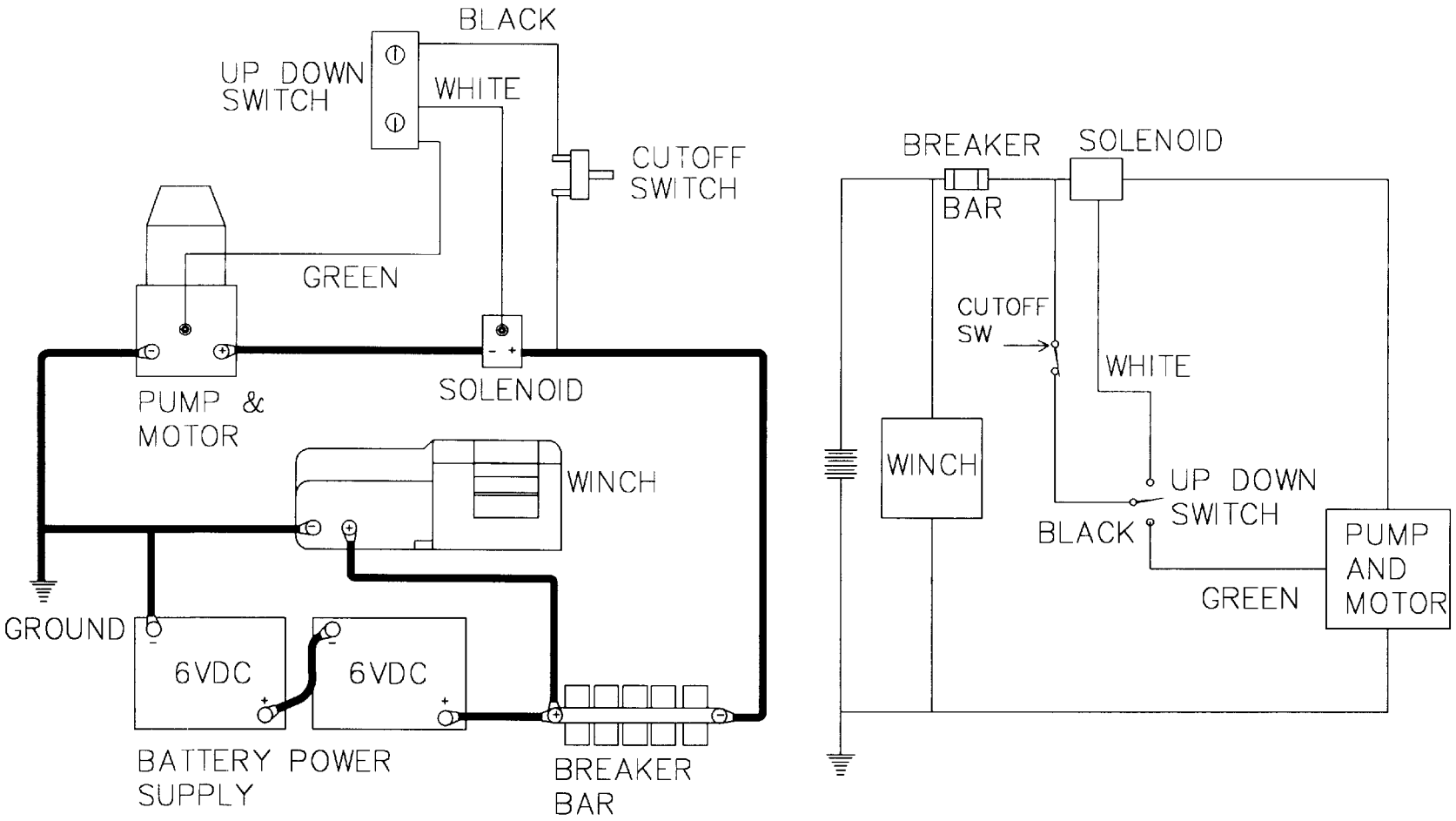
FIG. 24 is a schematic and wiring diagram of the power supply, winch, pump/motor, solenoid and switch of the lift cable and winch mechanism for lifting objects.
Figure 25:
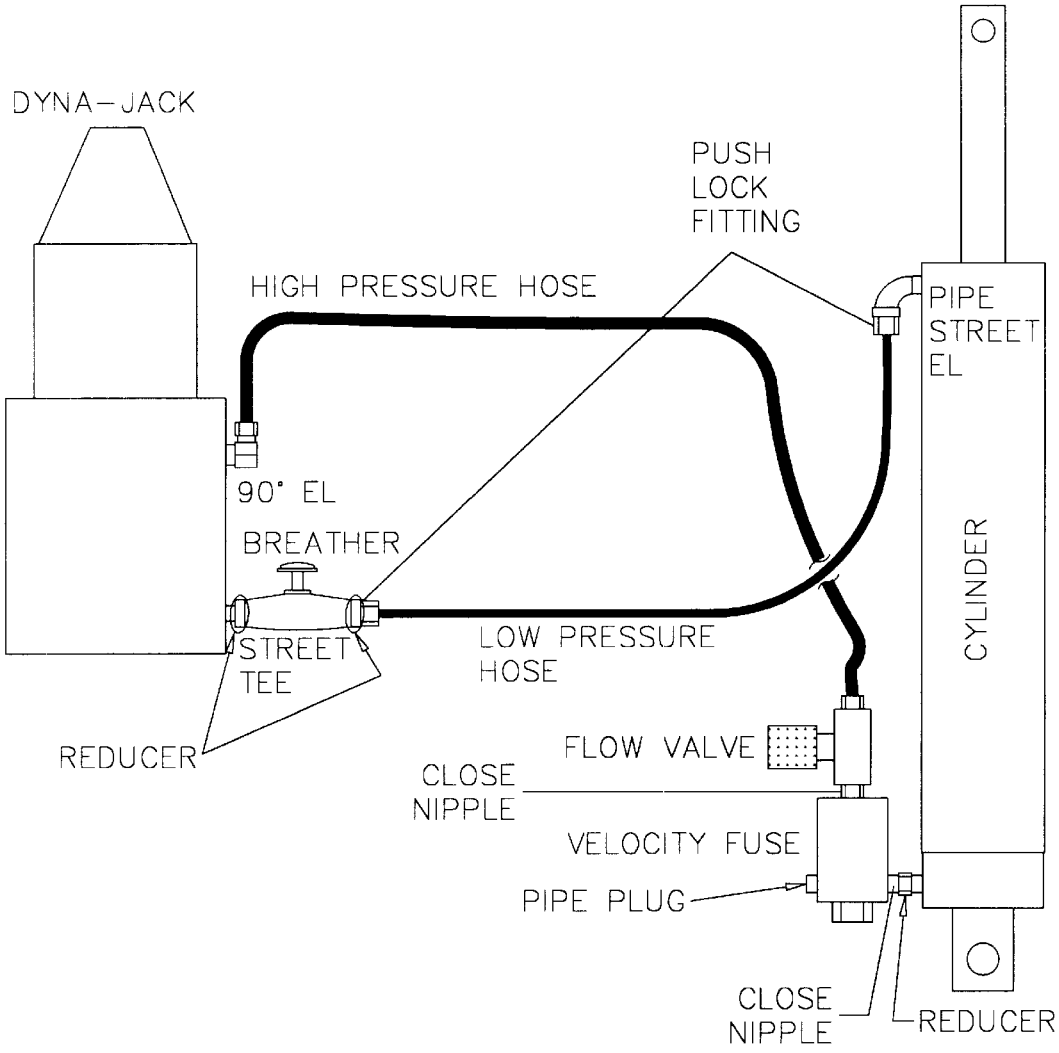
FIG. 25 is a schematic and fluid connection diagram of the boom actuating mechanism for raising and lowering objects.
Figure 26:
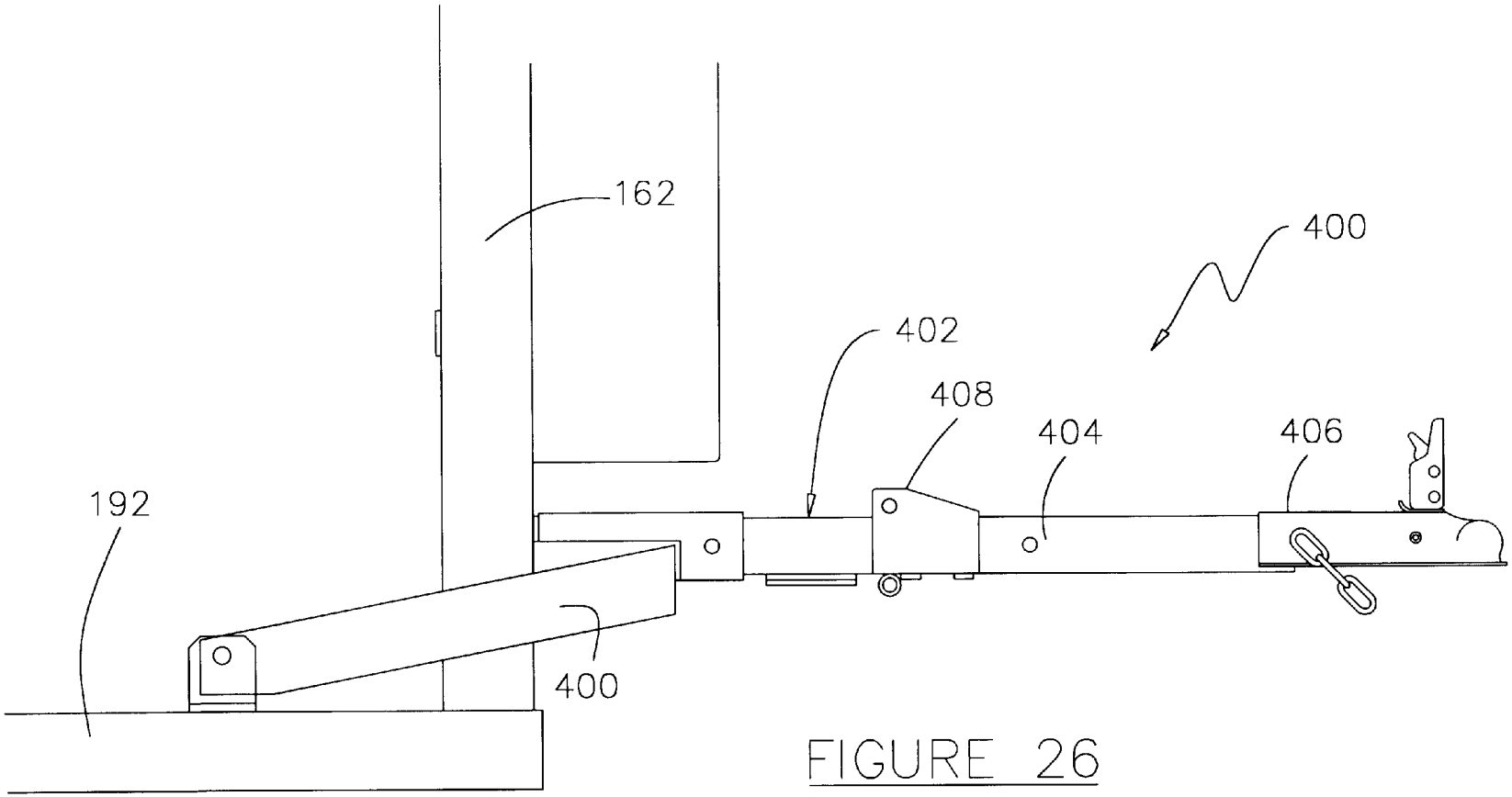
FIG. 26 is a side elevational view of an alternative embodiment of a tongue assembly for the lift mechanism.

Specifically, the selectively retractable and extendible boom 122 includes a plurality of boom sections. In the embodiment shown, boom 122 includes a base or main boom section 204 and four telescoping boom sections 205, 206, 207, and 208 as best shown in FIG. 11 where the boom is fully extended (and shown in a number of different positions including horizontal and fully retracted at A, two sections extended and angled up 45° at B, three sections extended and angled up 60° at C, and four sections or fully extended and angled up 75° at D where all of the boom sections are best shown). The above mentioned boom angle actuator 124 is pivotally connected to the main boom section 204 between its opposing ends and is responsible for the movement of the boom to the various angled positions shown in A–D. It is contemplated that the boom 122 may comprise more or less boom sections and still perform the same functions and/or be of the same dimensions overall. In one other scenario, the boom 122 has fewer segments such as three (3) or four (4). These segments may be of the same length as those described above thereby reducing the overall boom length, of a longer length such that the same overall boom length is maintained or even exceeded, or of a shorter length such that the overall boom length is shorter.

The boom sections may be of a variety of cross sectional shapes including square as is shown in FIG. 1, rectangular, any other polygonal shapes, or even round or oval. The rectangular shape is one of the preferred cross sectional shapes as it is stronger than many other shapes when loaded in a cantilevered manner.

As to the telescoping boom sections, boom section 205 is of a slightly smaller cross section than main boom section 204 so as to be slidable within the hollow main boom section 204. Similarly, boom section 206 is slightly smaller than boom section 205 so as to be slidable within boom section 205. Also similarly, boom section 207 is slightly smaller than boom section 206 so as to be slidable within boom section 206. Finally, boom section 208 is similarly slightly smaller than boom section 207 so as to be slidable within boom section 207.

Each retractable boom section 205–208 has a cuff 210 with an eyelet 212 (or similar ring, pair of offset and overlapping "C" shapes, or other cable constraining devices) on its outermost end which acts as a stop to prevent retraction of each entire boom section into the adjacent larger boom section. These eyelets guide a lift cable 216 that extends from winch 130 to snatch block 132 and serves to lift or drop any load attached to the hook 217 on the snatch block.

An alternative embodiment involves lift cable 216 extending through the boom sections 204–208 rather than affixed on top. This would provide some protection from environmental elements and also assure that should a lift cable snap it will not wildly fly through the air.

Some of the retractable boom sections further include stops that prohibit the complete removal of that boom section from the next largest boom section in which it slides. This functions as a positive safety stop so accidental boom section removal does not occur.

Main boom section 204 also includes a reinforcement bar 214 that supports the winch 130. This bar may be in several pieces welded together with each piece bent or angled so as to best reinforce the boom (this is shown in the figures where the bar is actually several bars welded together to form a triangular shape with the surface of the boom with a middle support therein).

As to each of the individual boom sections, pin receiving holes 218 extend through the boom sections and are selectively alignable to fix the boom sections within the larger boom sections that each slides within. These holes are arranged in a specific order so as to assure extending of the boom sections as desired by the manufacturer, specifically, so that the strongest boom sections are extended first (that is those with a larger cross section) since the holes in adjacent booms must align so that the pins 219 are insertable therethrough as are required in the holes to lock the boom sections in place thereby preventing retracting during loading. Preferably, boom section 205 extends first before any portion of sections 206–208. Once boom section 205 is fully extended from main section 204, then boom section 206 is extendable to a selected length. Once again, once boom section 206 is fully extended, then boom section 207 is extendable to a selected length. Finally, once boom section 207 is fully extended, then boom section 208 is extendable to a selected length or its full extension.

Alternatively, one or more of the boom sections may be designed for power hydraulic extension instead of manual extension and the use of pins to lock it in place. In one version, a power hydraulic system is attached to the second boom section 205 for hydraulic control of its extension and retraction from section 204.

In the embodiment displayed in the FIGS., about the end or nose of boom section 208 is a pulley or other mechanism 220 for receiving the lift cable 216 and redirecting it downward toward the snatch block 132. The boom section 208 also includes a hook receiver 222 for receiving a hook 224 about the end of lift cable 216. The lift cable 216 is thereby threaded through the snatch block 132 and affixed to the boom 122 at hook receiver 222.

The snatch block 132 includes a pulley or similar device 226 for receiving the cable whereby a pair of plates 228 sandwich the pulley 226 thereby holding the cable therein. The plates 228 also hold hook 217 therein at one end of the plates. The other end of the plates generally includes a pair of aligned holes 215. The snatch block 132 is designed such that it may be used with the hook 217 extending outward therefrom as shown in the FIGS., or flip flopped whereby the snatch block may be bolted or otherwise secured to an object (typically an immovable object) via the holes 215. The hook is obviously used for lifting whatsoever it is desired to lift. The hook sand/or holes are also useful in that either may be affixed to an immovable object whereby the winch is used to move to overall lift mechanism. Furthermore, this method may also be used to actually lift the entire lift mechanism up into the air, such as to lift it up onto a roof. Ear 213 with a hole therein is also useful during such activities as a place to hook or attach hook 217. The snatch block further serves to provide a doubling effect to the mechanical gain of the lift when hooked to ear 222.

The lift mechanism 100 also has the pair of rear retractable and extendible wheel frames 106 and 108 with rear wheels 110 and 112 thereon, and the pair of front retractable and extendible wheel frames 114 and 116 with front wheels 118 and 120 thereon. These wheel frames extend and retract from legs 150 and 152, and leg 190, respectively, so as to in a retracted position allow for towing of a standard sized trailer, while in an extended position allow for maximum stability of the lift.

As to rear wheel frames 106 and 108 as best shown in FIGS. 1, 4–5 and 10, each includes a support bar 240 of a complementary (preferably square or rectangular) yet smaller cross section than legs 150 and 152 so as to be slidable within the legs. Both of bar 240 and legs 150 or 152 include a plurality of holes in which a lock pin 241 is insertable once proper positioning is achieved so as to prevent accidental movement of the wheel frames within the leg. The support bars 240 have a jack connector 242 on its outermost end. A wheel axle support bracket 244 is attached to each bar 240 and rotatably supports axle 246 associated with one of the wheels 110 and 112.

Some form of braking system is generally provided to prohibit the unit from moving when the boom extended. One form is a wheel rotation prohibiting mechanism 248 is provided for each wheel. This wheel rotation prohibiting mechanism 248 as shown in more detail in FIGS. 15–16 includes a main bar 250 rotatably positioned in a sleeve 252 affixed to support bar 240 where a leverage bar 254 extends obliquely from the main bar. A locking bar 256 is attached to the main bar 250 and is pivotally movable into a wheel locking position where rotation of the wheel is blocked as the locking bar is pinned against the wheel. Another form is a braking mechanism within the actual rim of the wheel such as a drum braking system and this may optionally be placed on every wheel or just the steering or pivot wheel or wheels.

As to front wheel frames 114 and 116 as best shown in FIGS. 2–3, 5 and 10, each includes a support bar 260 of a complementary yet smaller cross section than leg 190 so as to be slidable within the leg where both of bar 260 and support 190 include a plurality of holes in which a lock pin 261 is insertable once proper positioning is achieved so as to prevent accidental movement of the wheel frames within the legs. The support bars 260 have a hole therein for receiving a pivotal vertical axle 262 for allowing turning of the wheels 118 or 120. This vertical axle 262 is affixed to a bracket 264 of bend nature that bends around to align with a horizontal axle 266 of the wheel 118 or 120 where the substantially horizontal axle is pivotal in the bracket.

In the case of either support bar 240 or 260, the complementary cross section requirement need not be of identical shape. For instance, the legs 152, 154, and 190 may be of a square or rectangular shape and the bars 240 or 260 of a similar square shape. Alternatively, the legs 152, 154, and 190 may of a square shape while the support bars 240 or 260 are of a round shape so as to selectively rotatable within the legs 150, 152 and 190 since pins secure the bar from rotation within the legs but rotation may be beneficial during axial adjustment in and out, or should jacks or other support be used thereby allowing the wheels to be pivoted out of the way. This is particularly useful on the support bars 260 since a round configuration allows the wheels 118 and 120 to be pivoted out of the way as is desirable in certain circumstances such as where an operator desires to tow the lift mechanism 100 using only the back wheels 110 and 112 with the hinge 174 locked. When this round extendible and retractable support bars, extensions, outriggers, etc. design, such as round extensions 260, is used with square legs, such as leg or axle 190, then often nubs are attached to the round extension to assist in preventing rotation when the extension is retracted while such nubs are positioned such that almost complete extension allows for nub removal from the leg or axle and thus rotation thereof.

Another embodiment includes the manufacture of the support bars 260 on the front wheels such that its inner portion is round while its outer portion is square (for instance, a round section may be welded to a square section where each is of a cross section that fits within the leg or axle 190). The square section would most likely be a majority of the extension or support bar 260 thereby prohibiting rotation over almost the entire extending whereby the round section would be a small portion of the innermost part of the bar such that the bar need not be removed to be rotated (dust almost fully extended).

Alternatively, all of the framing, legs, axles, bars, outriggers, extensions, etc. which are shown in the Figures as being of a square or rectangular construction could be of a round or other geometric construction.

A tool or other object storage chamber 280 may be provided as is shown in the figures. It may include a door, etc. This tool chamber 280 is interchangeable in position with the power supply 128 as needed. A platform could also alternatively be provided in place of the tool box.

A T-handle 290 may also be provided for a number of purposes including: (1) for use in moving the lift mechanism 100 when it is not attached via tongue 170 to a vehicle, (2) for use in steering the lift mechanism 100, (3) for use in braking the lift mechanism by acting as a wedge or similar stop, and (4) for use as a lever to lift rear wheels to allow the outriggers on the rear wheels to be extended. The T-handle is selectively removable from a slot 292 in the tongue. Additional slots may be placed on the tongue or at other locations for receiving the T-handle for use in moving the lift mechanism or for storage of the T-handle. When the T-handle is placed in the slot 290, the lift mechanism 100 may be steered, pulled or pushed.

As stated above, the T-handle is useful as a stop or brake as well as a lift for the lift mechanism as the T-handle includes a latch 291 that may selectively be wedged under a block 293 on the frame or seated over a pin 295 on the frame. Specifically, latch 291 may be wedged under block 293 with the T-handle pinned against the ground at an angle such that movement of the lift mechanism 100 in that same direction is not possible as the weight of the lift mechanism will stop such motion by the T-handle being urged against the ground. As to the latch 291 used to assist in lifting the lift mechanism, one of the pins 295 is seated within the latch 291 with the T-handle at a slight angle whereby the T-handle is then pivoted so as to lift the leg, outrigger, extension, etc. that the pin is on. This is particularly useful when extension or retraction of one of the wheel frames, and particularly the rear wheel frames 106 and 108 is desired as the T-handle lifts the leg 150 or 152 and te respective wheel frame 106 or 108 is thus lifted off of the ground and the retractions or extension may occur.

The tongue 170 as described above has a hinge 174 therein. The hinge is selectively lockable to be rigid or unlockable so as to hingedly flex for pivoting upward out of the way or for flexing during towing. As described above, this locking is performed by sliding of a rigid bar within the hinge whereby pivoting is selectively prohibited.

All of the pins 219, 241 and 261 are load bearing pins that lock within the hole each is inserted into by any of several methods including radial keys inserted through the pin to prohibit its removal. These pins are typically attached via chain, wire or other means to the adjacent parts such as to the boom, frame, legs, support bars, etc. whereby preferably each pin has a loop at its exposed end with a chain attached thereto that is connected to a ring about is other end that is affixed to the boom. Each pin may also have a head or collar to prevent complete insertion of the pin into its respective hole, or to support the pin when placed in a holder or other ring like receiver for storing the pin when not in use where the holder is attached to the boom. Each pin may also include a small hole in the end opposite the collar where the hole is for receiving a cotter key or pin, or like device for securing the pin within a hole by blocking its removal.

Once the pins are properly locked in after the support bars 240 and 260, and the boom sections 204–208 are properly extended or retracted (and typically the boom angle is chosen), then an object may be lifted by the lift mechanism where the object is hooked on to hook 217. Tilt indicator 134, as is best shown in FIGS. 17–20, indicates tilt of the lift mechanism 100 as the frames 102 and 104 flex and move in relation to one another and as leg 190 flexes and moves from end to end. Tilt indicator 134 includes a bar 300, a fastener 302 for pivotally fastening the bar 300 to one of the frames 102 or 104, and a connector 304 for connecting a portion of the bar spaced apart from fastener to the other of the frames 104 or 102, respectively. In operation, as the frames converge or diverge the pivotal bar 300 pivots since the connector is secured to the other of the frames. In one embodiment, the bar 300 is attached to a hook 306 and includes a weighted plate 308, a sleeve 310, and a main body 312 with a curled end 314. The connector 304 is a chain linked to the body 312 at one end and the hook 306 at the other end. As is shown, when too much weight is on the boom or the boom is extended too far or at the wrong angle for the weight, the first frame 102 begins to lift at the tower end thereby lifting chain 306 which pulls or pivots the tilt indicator 134 upward thereby showing unsafe tilt.

Other optional or standard features that may be incorporated into the lift mechanism 100 include the following. In the described and shown embodiment, the boom is manually telescoping; however, the boom is readily adapted to hydraulic or other automatic telescoping. In this scenario, each of the boom sections 204–208 is actuatable by a drive mechanism, such as a hydraulic actuator or electric motor for instance.

The tilt indicator 134 may also be electrically or otherwise connected to a light or other visual indicia that illuminates or otherwise indicates tilting when the tilt indicator reaches a certain predefined tilt measurement. In addition or alternatively, the tilt indicator 134 may also be electrically or otherwise connected to a buzzer, alarm or other audio indicia that emits an audible sound or otherwise audibly indicates tilting when the tilt indicator reaches a certain predefined tilt measurement. Furthermore, the tilt indicator 134 may also be electronically connected to the boom angle actuator 124, the winch 130, and any other motor or drive mechanism whereby when a preset tilt limit is exceeded, a switch shuts off the boom angle actuator, winch or other motor or drive mechanism.

The lift mechanism 100 may also include bubble levels on one, some or all of the first and second frames 102 and 104, and the legs, leg extensions, supports, outriggers, axles, etc. including 150, 152, 190, 240, and 260. This bubble level or other leveling device is useful for assisting the user in positioning the lift mechanism on level ground, adjusting the lift mechanism using jacks, or merely having knowledge of how level or unlevel the lift mechanism is.

In addition, the lift mechanism 100 may also include various other leveling device including one or more mercury switches for the monitoring of side to side balance of the lift mechanism. This mercury switch may be connected to a switch or other similar mechanism whereby when a preselected side to side tilt is reached, the switch shuts off the boom angle actuator, winch, or other motor or drive mechanism.

The lift mechanism 100 may also include an angle indicator on the boom for indicating the angle of the boom in relation to the ground on which the lift mechanism sets, or alternatively in relation to a horizontal imaginary plane.

The lift mechanism 100 may also include a power drive motor attached to one or more of the wheels for maneuvering or driving the vehicle as needed to properly position the vehicle or move the vehicle in a restricted area.

The lift mechanism is not only portable and towable as described above, it is movable by generally only one person as it is relatively lightweight. The lift mechanism is also easy to disassemble should it be desirable to load it into a truck, or move it to a location that is otherwise not attainable by rolling or driving it. For example, this lift mechanism can be disassembled, carried piece by piece inside of a building, and reassembled therein. Also, such disassembly, moving, and reassembly can occur to put the lift mechanism in an otherwise tight, hard to reach, constrained, confined, etc. spot. The disassembly merely requires the removal of pins 196 and 200 whereby the boom is removable from the frames 102 and 104 which are in turn removable from each other. The lift mechanism is now in much smaller and lighter pieces that are readily movable by one person, even through doorways, etc. The actuator may also be removed from the boom by removing the pin at the other end of the actuator thereby turning the two bolt disassembly into a three bolt disassembly.

Should more compact legs be desired, the lift mechanism is alternatively designable to include multiple telescoping legs, outriggers, etc. The embodiment shown displays legs, axles, etc. 150, 152, and 190 with one extension, outrigger, etc. retracting and extending therefrom (namely 240 and 260); however, multiple extensions or outriggers, etc. could telescopically extend and retract from the legs and axles in a manner similar to theat of boom 122.

Various safety switches are optionally available for the lift mechanism 100, some of which have previously been described. One safety switch that is available on the lift mechanism 100 is affixed or generally located on the first frame 102 while a plate or other surface for interacting with the switch is generally located on the second frame 104 whereby separation of the frames disconnects the plate from the switch thereby shutting down the actuators, motors and drives. One such application is to attached such a switch either in or on the battery box 128 about its bottom surface while providing such a plate or surface on the front wheel axle 190 whereby when tilting of the lift mechanism occurs, the battery box on the first frame 102 lifts away from the axle thereby deactivating the boom angle actuator 124, winch 130, etc.

The battery or batteries of the system within box 128 may be of any known type and number. For instance, the system may be designed to use two "6 volt" batteries, or two "12 volt" batteries, etc.

Winch 130 may be any type of lifting device such as a standard winch, hoist, or other mechanism capable of imparting lifting upon an object. The winch or hoist can be electric, hydraulic or of any other nature. In one version, the winch is a 2,000 pound hydraulic winch which eliminates the need for a snatch block 132.

One example of a specific embodiment of the above described lift mechanism 100 includes the boom 122 being capable of angular motion from approximately 5° to 10° below horizontal to almost vertical at approximately 75° to 80° above horizontal. The boom when fully retracted is of approximately 6 feet to 8 feet (and preferably approximately 7 feet to 7½ feet) in length while being of approximately 20 feet to 35 feet (and preferably 25 feet to 32 feet) in length when fully extended using the main boom section 204 and four extensions 205–208 (or alternatively a lesser number such as three that are each of a longer design).

These are boom lengths whereby the object is liftable above the floor the lift mechanism sits on a distance greater than these lengths and preferably approximately 28 feet.

In this one embodiment, the support arms 240 extend from and retract into the legs 150 and 152 from a fully retracted position of approximately 6 feet to 10 feet (and preferably approximately 8 feet) to a fully extended position of approximately from 8 feet to 12 feet (and preferably approximately 10 feet or slightly more). The support arms 260 extend from and retract into the leg 190 from a fully retracted position of approximately 3 feet to 5 feet (and preferably approximately 4 feet or slightly less) to a fully extended position of approximately from 5 feet to 8 feet (and preferably approximately 5 feet or slightly more).

In this same embodiment, the loads that may be lifted by the lift mechanism 100 range up to a maximum of 2,000 lbs. while still meeting all necessary safety factors and requirements. Safety factors for the overall unit range from a minimum of 1.25 to up to and beyond 7. The actual safe load lifting maximums are given by way of example as follows: at a 75° angle as is show by boom D, 810 lbs. lifted to approximately 28 feet in height, 920 lbs. lifted to approximately 24 feet in height, 1450 lbs. lifted approximately 18 feet in height, and 1500 lbs. lifted to approximately 15 feet in height, and 2000 lbs. lifted to approximately 10 feet in height; at a 60° angle as is show by boom C, 480 lbs. lifted to approximately 22 feet in height, 750 lbs. lifted to approximately 18 feet in height, and 1500 lbs. lifted to approximately 14 feet in height; and at a 45° angle as is show by boom B, 530 lbs. lifted to approximately 15 feet in height, and 1270 lbs. lifted to approximately 12 feet in height.

In an alternative embodiment, the extensions 114 and 116, and the wheels 118 and 120 as well as the handle 290 are replaced by an improved steering mechanism 400 as is shown in FIGS. 26–30D. The improved steering mechanism 400 includes a modified tongue 170'. In this embodiment, the tongue 170' is not attached to the vertical tower or mast 162 and is instead connected to pivot arms 192 and 194 so as to move with second frame 104 as the wheels 118 and 120 do in the above described embodiment. The modified tongue 170' pivots and when pivoted to its upward maximum contacts with the mast 162 as is shown in the FIG. 26. The modified tongue 170' freely pivots downward away from the mast although as described above, the tilt indicator 300 serves to prohibit too much tilting by the first frame 102.

Figure 29A:
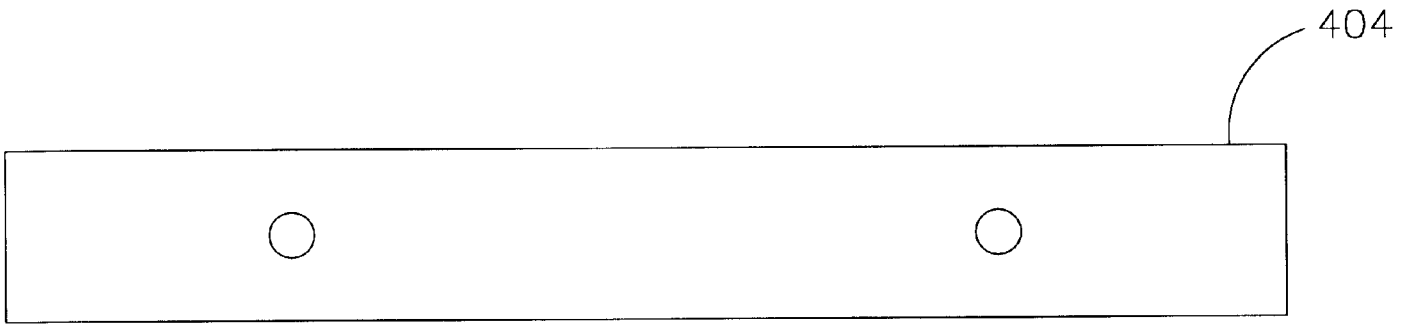
FIG. 29A is a side view of the slug of the tongue assembly of FIG. 26.
Figure 29B:
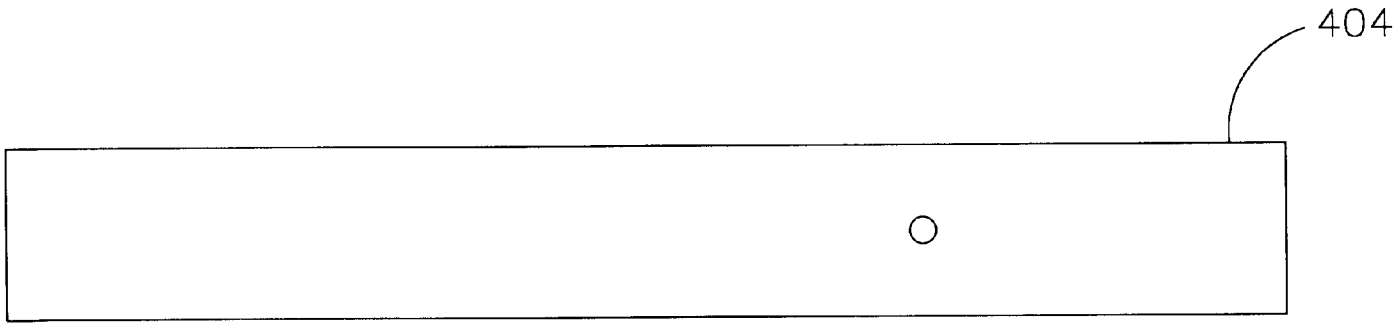
FIG. 29B is a top view of the slug of FIG. 29A.
Figure 30A:
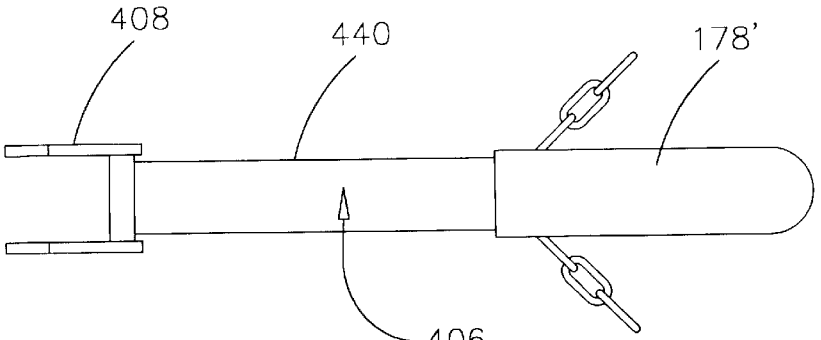
FIG. 30A is a top plan view of the tongue portion of FIG. 26.
Figure 30B:
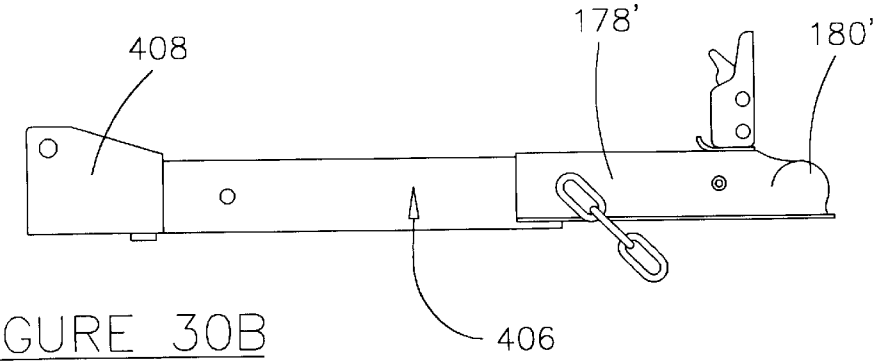
FIG. 30B is a side elevational view of the tongue of FIG. 30A.
Figure 30C:
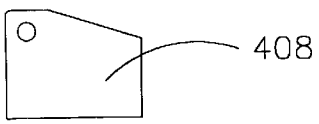
FIG. 30C is a side view of the hinge on the tongue of FIG. 30B.
Figure 30D:
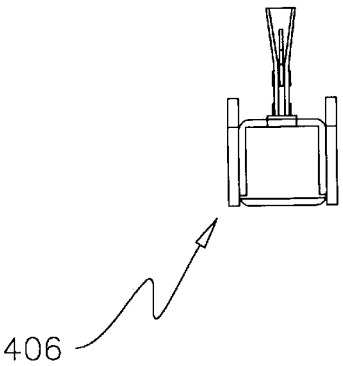
FIG. 30D is an end view of the tongue of FIGS. 30A–30B

The modified tongue 170' includes a tongue mounting fork 400 as best shown in FIGS. 27A, 27B, 27C and 27D, a caster mounting bracket 402 as best shown in FIGS. 28A, 28B, 28C and 28D, a slug 404 as best shown in FIGS. 29A and 29B, and a tongue assembly 406 with a hinge 408 thereon as best shown in FIGS. 30A, 30B, 30C and 30D.

Figure 27D:
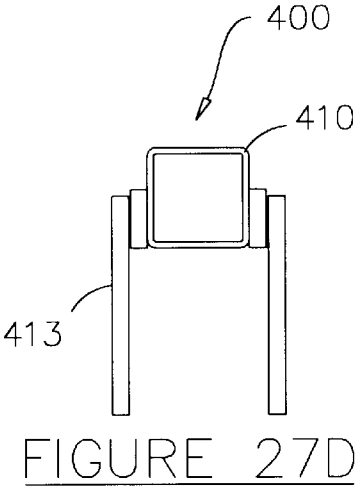
FIG. 27D is an end view of the mounting fork of FIGS. 27A–27B.
Figure 27A:
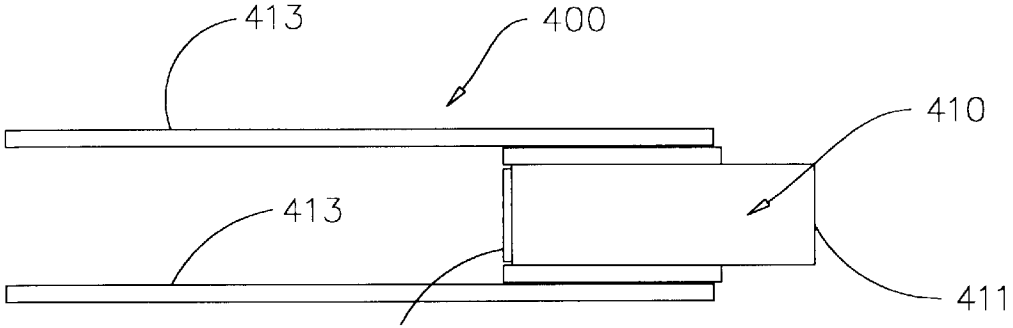
FIG. 27A is a top view of the tongue mounting fork of the tongue assembly of FIG. 26.
Figure 27B:
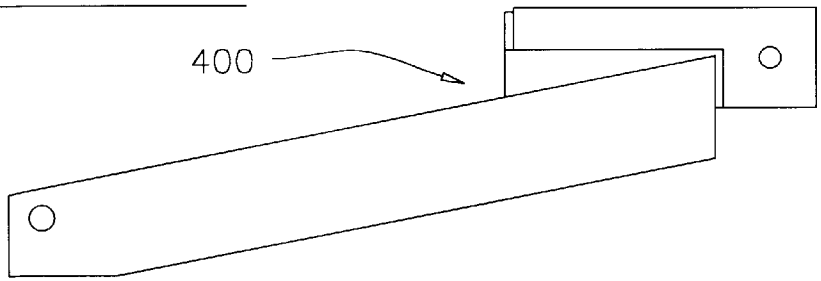
FIG. 27B is a side elevational view of the tongue mounting fork of the tongue assembly of FIG. 27A.
Figure 27C:
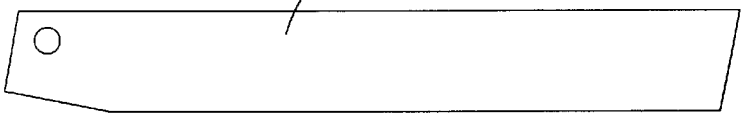
FIG. 27C is a side elevational view of one of the tines of the mounting fork of the tongue assembly of FIG. 27B.
Figure 28A:
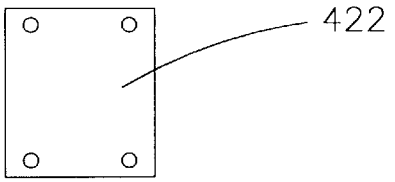
FIG. 28A is a plan view of the mounting plate of the tongue assembly of FIG. 26.
Figure 28B:
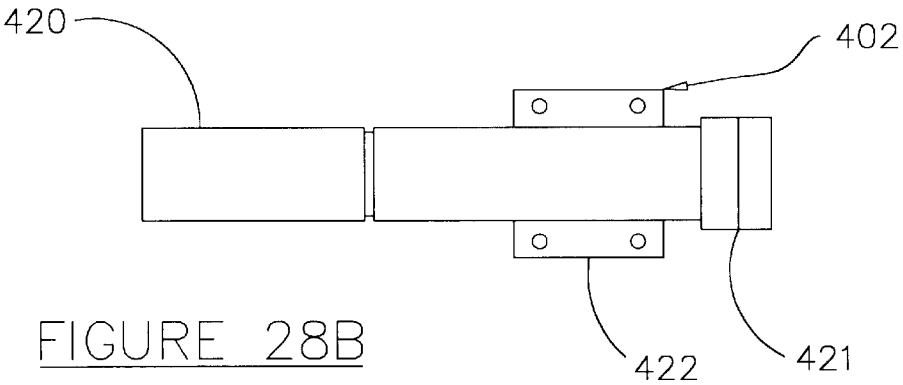
FIG. 28B is a bottom view of the caster mounting bracket which includes the mounting plate of FIG. 28A.
Figure 28C:
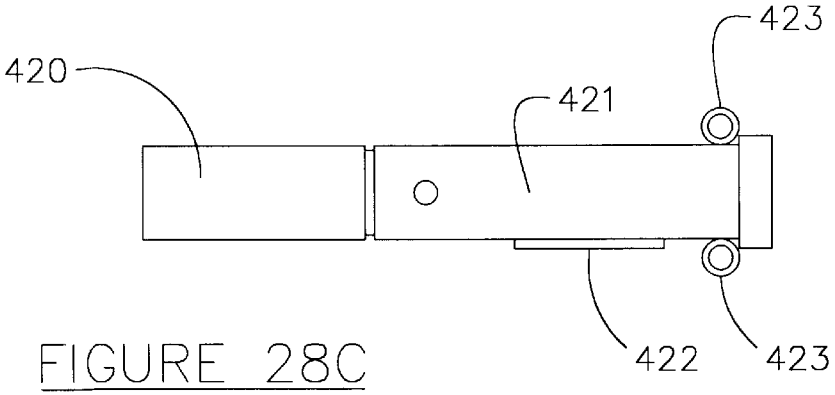
FIG. 28C is a side elevational view of the caster mounting bracket of FIG. 28B.
Figure 28D:
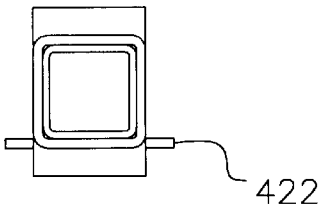
FIG. 28D is an end view of the caster mounting bracket of FIGS. 28B–28C.

Tongue mounting fork 400 includes a receiver tube 410 with an open end 411 and a closed end 412. The fork 400 further includes a pair of tines or plates 413 extending diagonally therefrom as best shown in FIG. 27A and 27B. These tines 413 extend around the mast 162 and attach to pivot connectors 196 as shown in the embodiment of FIGS. 1–25.

Caster mounting bracket 402 includes a tubular end 420 and a square or rectangular end 421 with a mounting plate 422 thereon. The end 421 further includes a pair of tubes 422 and 423 tangentially mounted perpendicularly to the axis of the bracket as shown in FIGS. 28A–28D. One of these tubes serves as the pivot axis to the hinge 408.

Slug 404 is an elongated square or rectangular tube that corresponds in shape to end 421 and is of a size so as to be seatable therein. Various holes are drilled in slug 404 to correspond with holes in end 421 such that a pin may be insertable therein to hold slug 404 within end 421. Various other holes serve to allow for pinned connection of the tongue assembly 406 over the slug 404 so as to prohibit its hinged movement when the tongue assembly is fully inserted.

Tongue assembly 406 includes hinge body 408, connection tube 440 which is of the same cross sectional shape as the slug but a slightly larger dimension so as to fit over it, and an actual hitch portion 178' with a hitch socket 180' therein. The hinge body 408 is pivotable about a pin inserted through both the hinge body 408 and one of the tubes 422 and 423.

The tongue assembly 406 when fully inserted is rigid with the slug 404 and caster mounting bracket 402; however, the tongue assembly 406 may be removed from the slug whereby the hinge 408 allows for its pivotable movement out of the way. In this manner, a rigid tongue is provided for during towing, while it is removable or pivotable out of the way when not needed. A handle such as 290 is no longer needed as the tongue assembly when pivoted upward may function in the same capacity.

A caster assembly 450 is available for connection to mounting plate 422. It includes a mount 452, a race and bearing assembly 454, a rigid main support 456, an axle 458 and a pair of casters 460 on each of the axle. The race allows for pivotal movement of the assembly 450 as needed. The assembly 450 allows for pivoting of the entire lift mechanism 100.

It is also an option to move the jack connectors 242 from the extensions 106 and 108 to the legs 150 and 152. This allows some models of the lift mechanism to have wheels 110 and 112 attached to the legs rather than extensions.

Accordingly, the lift mechanism is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved lift mechanism is constructed and used, the characteristics of the construction, and the advantageous, new and useful results obtained; the new and useful structures, devices, elements, arrangements, parts and combinations, are set forth in the appended claims.

We claim:

1. A lift mechanism comprising:

a first rigid frame including a pair of legs connected at a proximate end and each extending outward to a distal end having a leg wheel approximate thereto, and the first frame also including a hitch thereon;

a second rigid frame pivotally connected to the first frame whereby one of the first and second frames is substantially vertically freely pivotable about a axis transverse to the longitudinal axis of the frames as the frames are loaded, the second frame including a main axle support having opposing ends with an axle wheel approximate to each end;

a telescopic boom pivotally attached to at least one of the frames; and a winch for use with the boom and having a lift cable extending along the boom with a hook thereon.

2. The lift mechanism of claim 1 further comprising a tilt indicator mechanism extending between the frames indicative of unsafe tilting of one of the first and second frames with reference to other of the first and second frames.

3. The lift mechanism of claim 2 wherein the tilt indicator includes a rigid bar having a proximate end pivotally fastened to one of the first and second frames and a distal end connected to the other of the first and second frames by a device that is flexible until it is fully extended whereby it becomes rigid and pivots the tilt indicator.

4. The lift mechanism of claim 2 wherein the tilt indicator includes a mercury switch.

5. The lift mechanism of claim 2 wherein the tilt indicator includes an optical sensor.

6. The lift mechanism of claim 3 further comprising a safety switch that for deactivating at least one of the lifting and extending of the boom when unsafe conditions are encountered.

7. The lift mechanism of claim 1 further comprising a safety switch that for deactivating at least one of the lifting and extending of the boom when unsafe conditions are encountered.

8. The lift mechanism of claim 1 wherein the hitch includes a pivot therein for allowing for pivotal movement of the hitch when the hitch is not needed.

9. The lift mechanism of claim 8 further comprising a sliding lock which when in a first position holds the hitch in a closed and pivot prohibited position while when in a second position freely allows the hitch to pivot.

10. The lift mechanism of claim 1 wherein each of the legs includes a first section with a second section telescoping therefrom.

11. The lift mechanism of claim 1 wherein the axle includes a main section with an extension telescoping from each end thereof.

12. The lift mechanism of claim 1 wherein each of the legs includes a first section with a second section telescoping therefrom, the axle support includes a main section with an extension telescoping from each end thereof, and the telescopic boom includes a plurality of boom sections with the smaller sections fitting within the next larger section, and whereby the lift mechanism when all of the telescoping leg sections, axle sections, and boom sections are retracted is of an approximately eight foot width and twelve foot length.

13. The lift mechanism of claim 12 wherein the boom extends to in excess of thirty feet when all of the boom sections are fully extended.

14. The lift mechanism of claim 13 wherein the boom has a range of between approximately 5° to 15° below horizontal to approximately 75° to 85° above horizontal.

* * * * *